US010463132B2

(12) United States Patent
Ziemann

(10) Patent No.: US 10,463,132 B2
(45) Date of Patent: Nov. 5, 2019

(54) MAKEUP CASE

(71) Applicant: Kelsi Ziemann, West Des Moines, IA (US)

(72) Inventor: Kelsi Ziemann, West Des Moines, IA (US)

( * ) Notice: Subject to any disclaimer, the term of this patent is extended or adjusted under 35 U.S.C. 154(b) by 0 days.

(21) Appl. No.: 16/055,238

(22) Filed: Aug. 6, 2018

(65) Prior Publication Data

US 2018/0338601 A1 Nov. 29, 2018

Related U.S. Application Data

(63) Continuation-in-part of application No. 15/245,236, filed on Aug. 24, 2016, now Pat. No. 10,064,474.

(60) Provisional application No. 62/210,333, filed on Aug. 26, 2015.

(51) Int. Cl.

| | |
|---|---|
| ***A45D 40/18*** | (2006.01) |
| ***A45D 40/20*** | (2006.01) |
| ***A45D 40/00*** | (2006.01) |
| ***A45D 40/24*** | (2006.01) |

(52) U.S. Cl.

CPC ..... *A45D 40/18* (2013.01); *A45D 40/20* (2013.01); *A45D 40/24* (2013.01); *A45D 2040/0006* (2013.01)

(58) Field of Classification Search

CPC ..... A47K 7/03
USPC ..... 401/19
See application file for complete search history.

(56) References Cited

U.S. PATENT DOCUMENTS

| | | | |
|---|---|---|---|
| 3,062,222 | A | 11/1962 | Quinn |
| 4,778,300 | A | 10/1988 | French |
| D370,088 | S | 5/1996 | Burns |
| 5,715,848 | A | 2/1998 | Conley, Jr. |
| 5,979,468 | A | 11/1999 | Blake, III |
| 6,141,838 | A | 11/2000 | Cooper |
| 6,450,179 | B2 | 9/2002 | Bengis |
| 6,588,435 | B1 | 7/2003 | Gindi |
| 7,007,700 | B2 | 3/2006 | Burroughs |
| 8,156,949 | B2 | 4/2012 | Albert |
| 8,221,014 | B1 | 7/2012 | Houston |
| 2004/0086317 | A1 | 5/2004 | Hanna |
| 2004/0187885 | A1 | 9/2004 | Strong |
| 2005/0150513 | A1 | 7/2005 | Taylor |
| 2014/0341631 | A1 | 11/2014 | Cakridas |

*Primary Examiner* — Lori L Baker
(74) *Attorney, Agent, or Firm* — Christopher A. Proskey; BrownWinick Law Firm

(57) ABSTRACT

A lipstick case system is presented that helps to keep two paired makeups together. As one example, a lipstick case is presented having a cover, a base, and a pencil. A holder is positioned in an exterior surface of the cover. The holder is sized and shaped to receive a pencil, such as a lip liner pencil or eyeliner pencil or brush, therein. The holder includes lips that extend past a centerline or maximum diameter of the pencil. A pencil is inserted into the holder by providing sufficient force to deflect the opposing lips thereby allowing the pencil to reside within the rectangular holder while being frictionally held therein. The pencil is similarly removed by providing sufficient force to overcome this frictional engagement thereby allowing the pencil to be removed from the holder.

20 Claims, 28 Drawing Sheets

MAKEUP CASE

CROSS REFERENCE TO PRIOR APPLICATION

This application is a continuation in part of U.S. patent application Ser. No. 15/245,236 which was filed on Aug. 24, 2016, which claims priority from U.S. Provisional Application No. 62/210,333 filed Aug. 26, 2015, the entirety of which is incorporated herein fully by reference.

FIELD OF THE INVENTION

This invention relates generally to makeup. More specifically, and without limitation, this invention relates to a case with a pencil or lip liner holder and/or a lipstick holder.

BACKGROUND OF INVENTION

Cosmetics, also known as makeup or make-up (hereinafter makeup) are substances used to enhance the appearance of the human body. There are countless forms of makeup. Makeup is generally formed of generally mixtures of pigments and fragrances, some being derived from natural sources (such as coconut oil) and many being synthetics. Common types of makeup include primer, lipstick, lip gloss, lip liner, concealer, foundation, face powder, rouge, blush, mascara, eyeliner, nail polish, and the like, just to name a few.

Each of the various types of makeup come in countless shades, textures, colors, consistencies, etc. Conventionally, different colors of makeup are paired with one another. As an example, one color of lipstick is often paired with one color of lip liner. Or, as another example, one color of lipstick is often paired with one color of eyeliner. To complicate matters, fashionable trends are constantly changing which causes these parings to constantly change.

Keeping makeup pairings together can be a challenge. This is especially true in light of the fact that many makeup users own a great number of lipsticks, eyeliners, lip liners, and the like.

As one example of the deficiencies in the current state of the art, makeup is often stored in disarray in makeup bags or makeup cases where a plurality of similar colors and styles of the same type of makeup are simply dumped in together in general disarray. The result is that a single makeup bag may include several lipsticks and several lip liners and several eyeliners that all look quite similar to one another. This can cause the user to conduct a substantial search to re-pair the right lipstick with the right lip liner. This can also cause delays in the makeup application process as well as lead to frustration. This also opens the door to accidently pairing the wrong two makeups with one another, which can require removal and reapplication of makeup, which leads to further delay and frustration.

As another example of the deficiencies of the current state of the art, users often place paired lipstick and lip liner in a purse along with countless other objects. While the lipstick and the lip liner are often placed in the purse at the same time, in the process of carrying the purse the lipstick and lip liner tend to get separated from one another and get lost among the other contents of the purse. When it comes time to apply or reapply makeup, the user must search for both makeups (e.g. the lipstick and the lip liner) which can cause delays in the makeup application process as well as lead to frustration.

Many attempts have been made to solve these problems, examples include:

- U.S. Pat. No. 7,007,700 to Burroughs entitled Cosmetic Holder Apparatus issued on Mar. 7, 2006;
- U.S. Pat. No. 5,715,848 to Conley, Jr. entitled Lipstick Holder System issued Feb. 10, 1998;
- U.S. Pat. No. 3,062,222 to E. W. Quinn entitled Lipstick Attachment issued Nov. 6, 1962;
- U.S. Pat. No. 8,156,949 to Albert et al. entitled Cosmetic Storage and Application Device issued Apr. 17, 2012;
- U.S. Pat. No. 6,588,435 to Gindi entitled Cosmetics Apparatus issued Jul. 8, 2003;
- United States Patent Application No. 2004/0086317 to Hanna entitled Holder for Releasably Holding Conventional Cosmetic Tools published May 6, 2004;
- U.S. Pat. No. D370,088 to Burns entitled Combination lipstick and lip liner dispenser issued May 21, 1996;
- U.S. Pat. No. 5,979,468 to Blake III entitled Tube for Lipstick and the Like issued Nov. 9, 1999;
- U.S. Pat. No. 6,450,179 to Bengis entitled Cosmetics Container with Interchangeable Attachments issued Sep. 17, 2002;
- U.S. Pat. No. 4,778,300 to French et al. entitled Case for an Applicator Element issued Oct. 18, 1988;
- U.S. Pat. No. 8,221,014 to Houston entitled Lipstick Applicator Brush Attachment System issued Jul. 17, 2012;
- United States Patent Application No. 2004/0187885 to Strong et al. entitled Application Devices and Brushes for use Therewith Published Sep. 30, 2004;
- United States Patent Application No. 2014/0341631 to Cakridas et al. entitled Multipurpose Cosmetic Carrying System published Nov. 20, 2014;
- United States Patent Application No. 20050150513 to Taylor entitled Cosmetic Mirror Detachably Affixed to Lipstick Carrier published Jul. 14, 2005;

Despite these many attempts, currently, there is no convenient and elegant systems, manners or methods for keeping paired makeups together.

Therefore, for the reasons stated above, and for other reasons stated below which will become apparent to those skilled in the art upon reading and understanding the specification, claims and drawings, there is a need in the art for an improved makeup case.

Thus, an object of the invention is to provide an improved makeup case and method of use that improves upon the present state of the art.

Another object of the invention is to provide an improved makeup case and method of use that is elegant.

Yet another object of the invention is to provide an improved makeup case and method of use that helps to keep two paired makeups together.

Another object of the invention is to provide an improved makeup case and method of use that is easy to use.

Yet another object of the invention is to provide an improved makeup case and method of use that is relatively inexpensive to manufacture.

Another object of the invention is to provide an improved makeup case and method of use that helps save a user time.

Yet another object of the invention is to provide an improved makeup case and method of use that helps prevent user frustration.

Another object of the invention is to provide an improved makeup case and method of use that helps prevent errant re-pairing of makeup.

Yet another object of the invention is to provide an improved makeup case and method of use that helps to prevent reapplying makeup because the wrong makeup was applied.

Another object of the invention is to provide an improved makeup case and method of use that helps to prevent losing makeup.

Yet another object of the invention is to provide an improved makeup case and method of use that is safe to use.

Another object of the invention is to provide an improved makeup case and method of use that has a simple design.

Yet another object of the invention is to provide an improved makeup case and method of use that can be used with any form of makeup.

Another object of the invention is to provide an improved makeup case and method of use that helps to identify what lipstick goes with what lip liner or eyeliner.

Yet another object of the invention is to provide an improved makeup case and method of use that allows two makeups to be quickly joined.

Another object of the invention is to provide an improved makeup case and method of use that allows two makeups to be quickly separated.

Yet another object of the invention is to provide an improved makeup case and method of use that has a robust design.

Another object of the invention is to provide an improved makeup case and method of use that has a long useful life.

Yet another object of the invention is to provide an improved makeup case and method of use that is durable.

Another object of the invention is to provide an improved makeup case and method of use that has an intuitive design.

Yet another object of the invention is to provide an improved makeup case and method of use that allows joinder of a lip liner or eye liner pencil with a lipstick without having to remove the cover from the lipstick.

Another object of the invention is to provide an improved makeup case and method of use that that allows removal of a lip liner or eye liner pencil from a lipstick without having to remove the cover from the lipstick.

Yet another object of the invention is to provide an improved makeup case and method of use that allows combination of a pencil of any length with a lipstick.

Another object of the invention is to provide an improved makeup case and method of use that can be easily used by persons with limited dexterity.

Yet another object of the invention is to provide an improved makeup case and method of use that firmly and securely holds a pencil with a lipstick while not being so tight of a hold that the pencil is difficult to separate from the lipstick. Another object of the invention is to provide an improved makeup case and method of use that will save consumers time during the makeup shopping process because it allows pairing of complimenting colors either directly from the manufacturer or at the store.

These and other objects, features, or advantages of the invention will become apparent from the specification and claims.

SUMMARY OF THE INVENTION

A makeup case system is presented that helps to keep two paired makeups together. As one example, a lipstick case is presented having a cover and a base. A holder is positioned in an exterior surface of the lipstick case, that when viewed from above or below is semi-circular in shape. The holder is sized and shaped to receive a pencil, such as an eyeliner pencil or lip liner pencil or brush, therein. The holder includes lips that extend past a centerline or maximum diameter of the pencil. A pencil is inserted into the holder by providing sufficient force to deflect the opposing lips thereby allowing the pencil to reside within the semi-circular holder while being frictionally held therein. The pencil is similarly removed by providing sufficient force to overcome this frictional engagement thereby allowing the pencil to be removed from the holder.

DETAILED DESCRIPTION OF THE INVENTION

Figure 1:
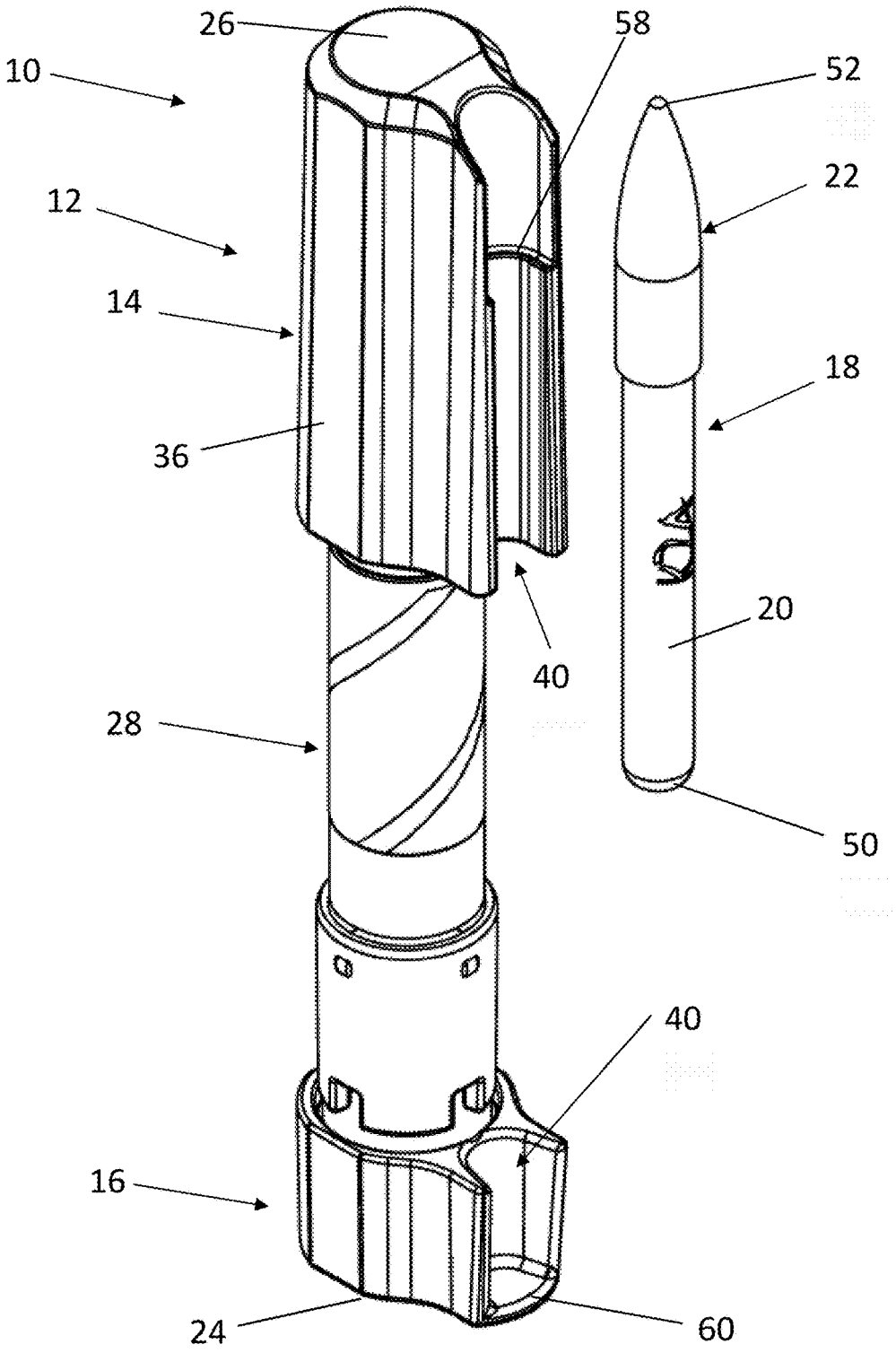
FIG. 1 is a perspective front view of a makeup case system, the system showing the cover removed from the base, and the pencil removed from the holder in the cover and the base, the view also showing the lipstick deployment mechanism held within the cover and the base.
Figure 2:
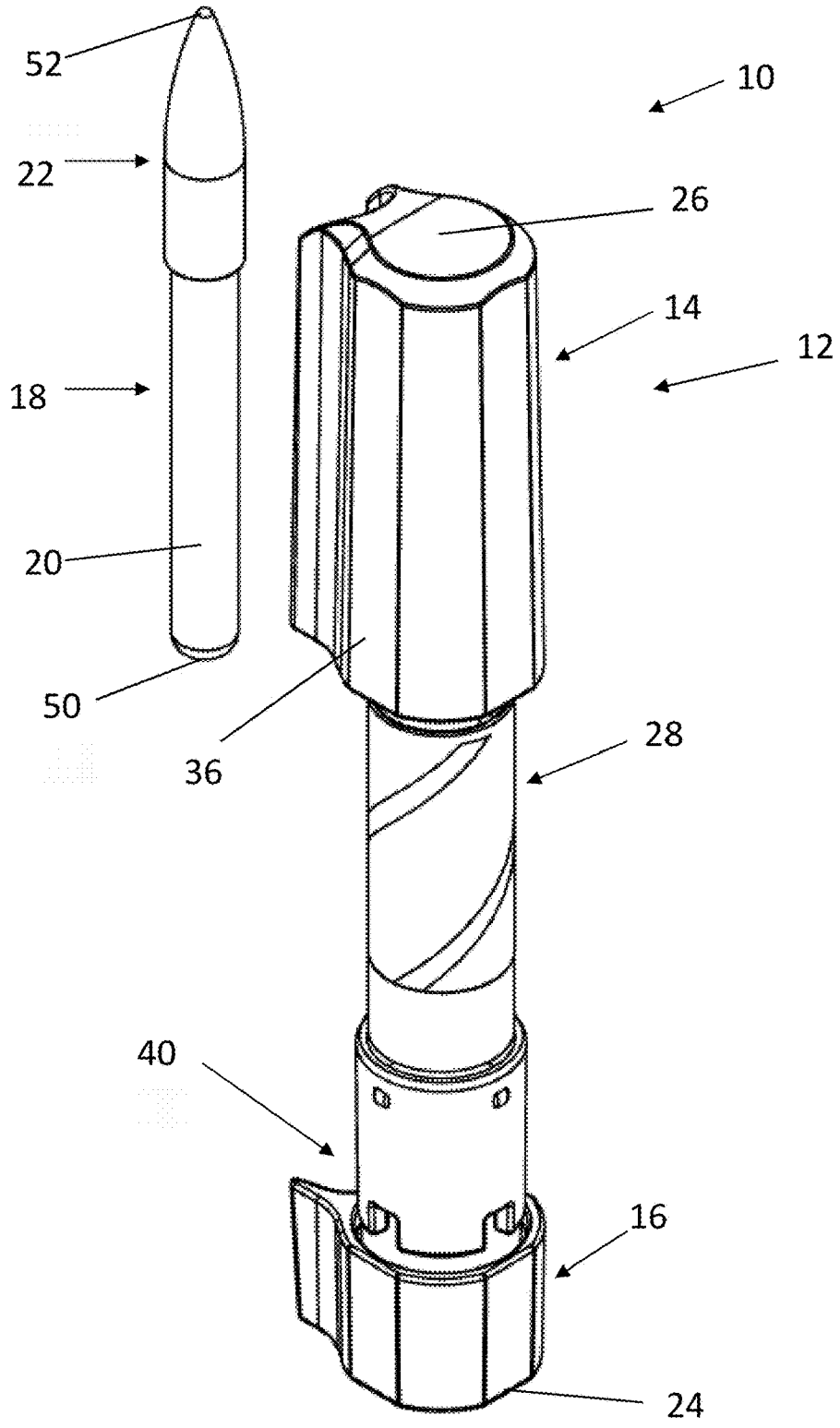
FIG. 2 is a perspective rear view of the makeup case system as shown in FIG. 1.
Figure 3:
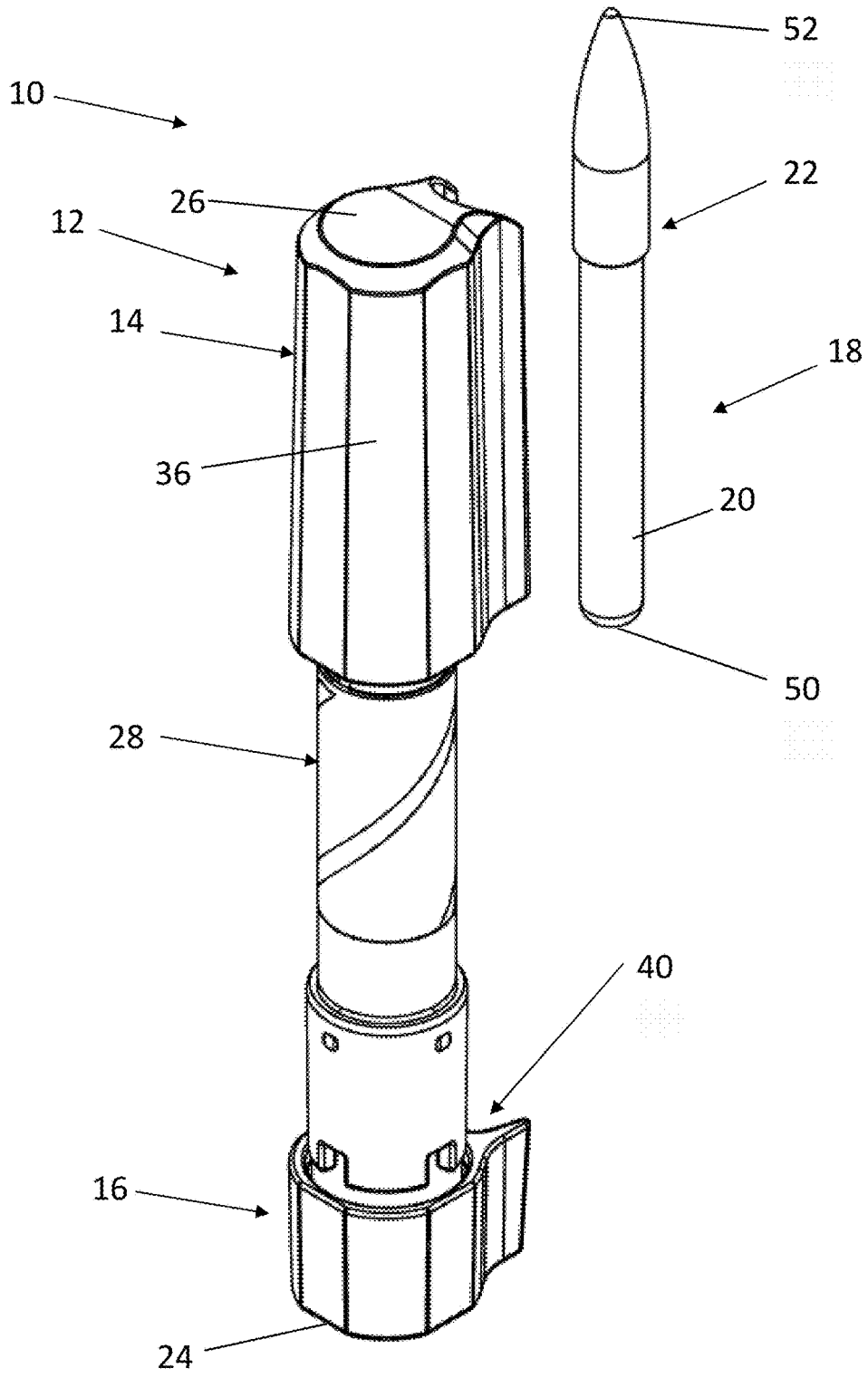
FIG. 3 is a perspective rear view of the makeup case system as shown in FIGS. 1 and 2.
Figure 4:
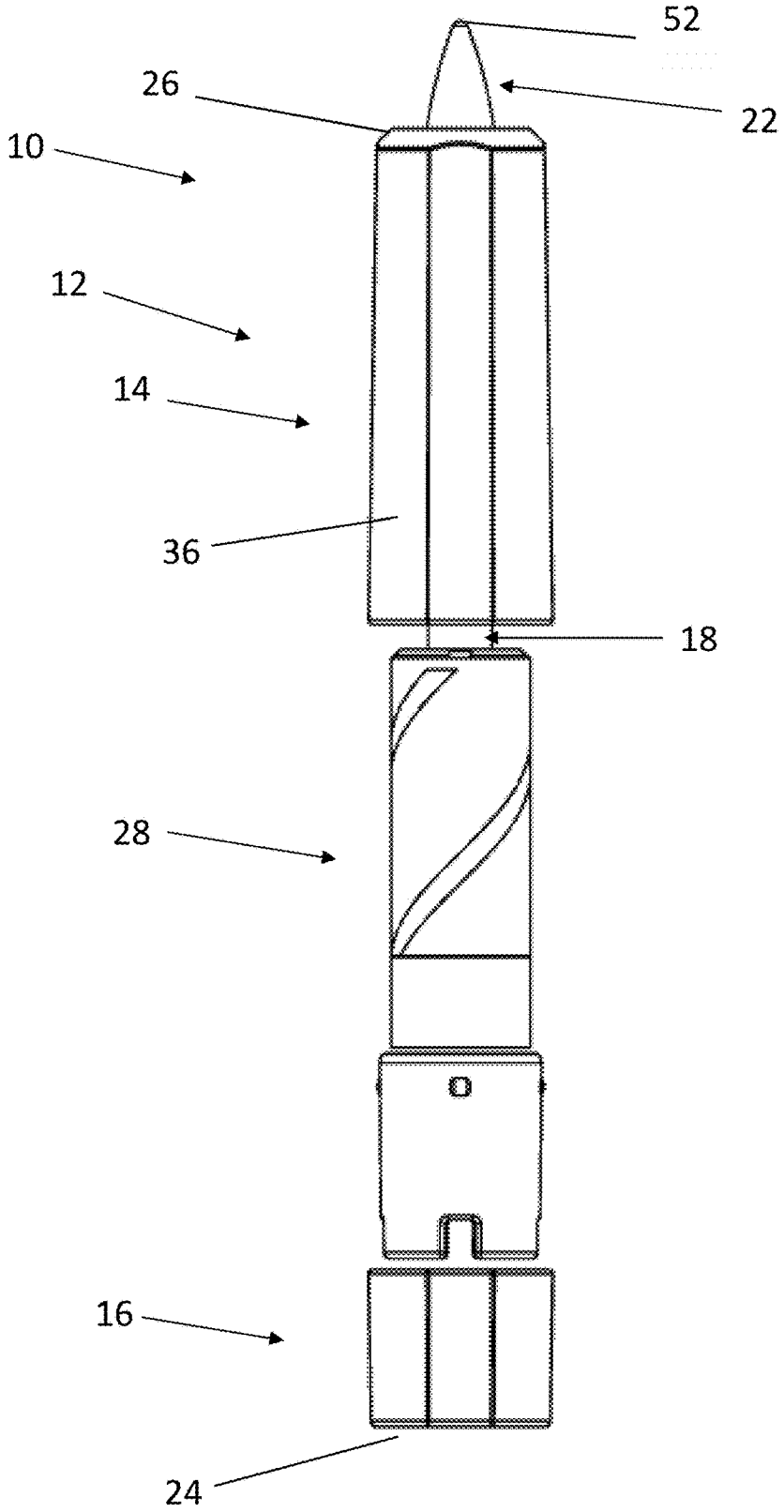
FIG. 4 is a rear elevation view of the makeup case system as shown in FIGS. 1-3.
Figure 5:
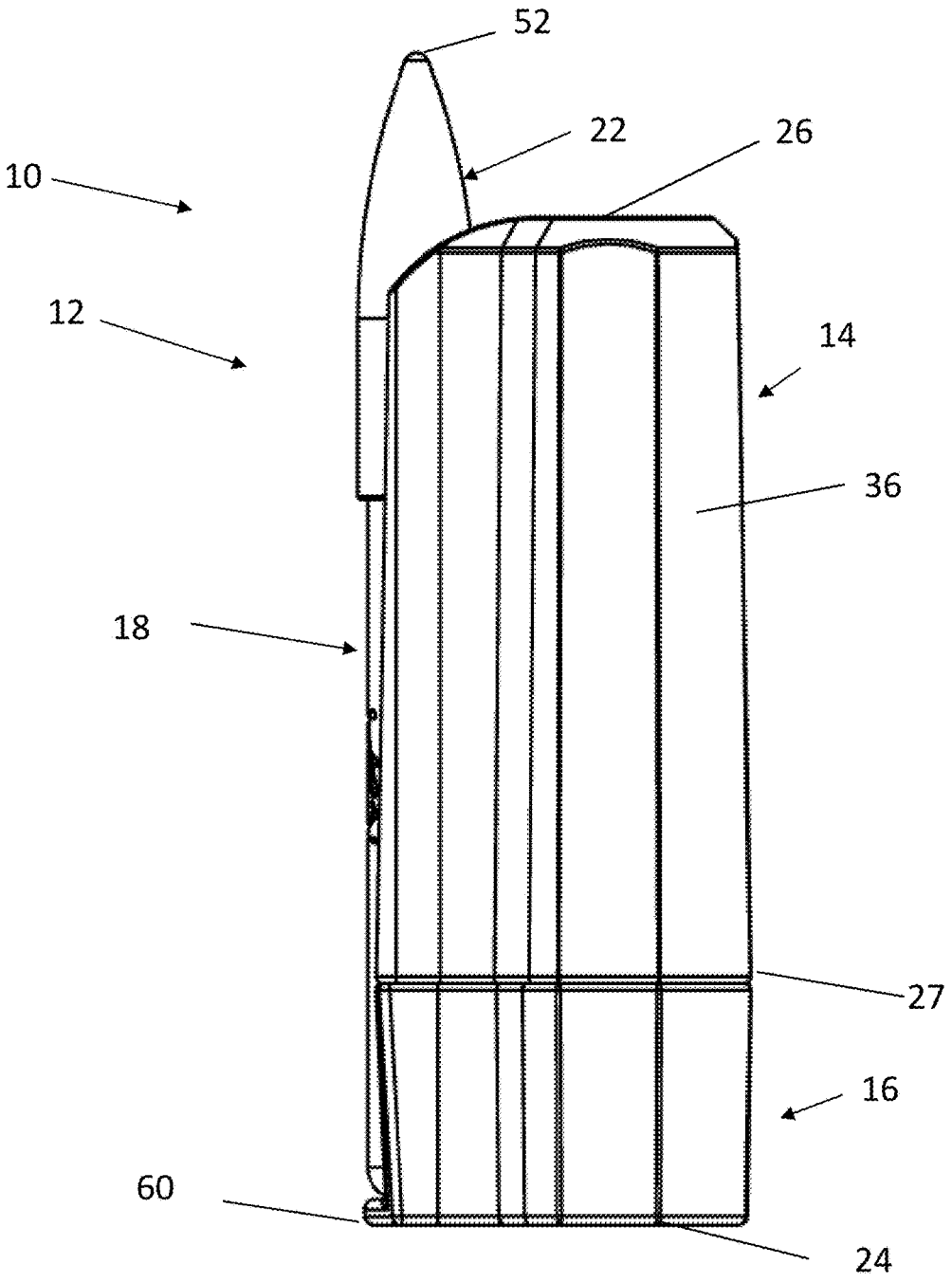
FIG. 5 is a side elevation view of the makeup case system as shown in FIGS. 1-4, the view showing the cover and base closed around the deployment mechanism, and the pencil held within the holder.
Figure 6:
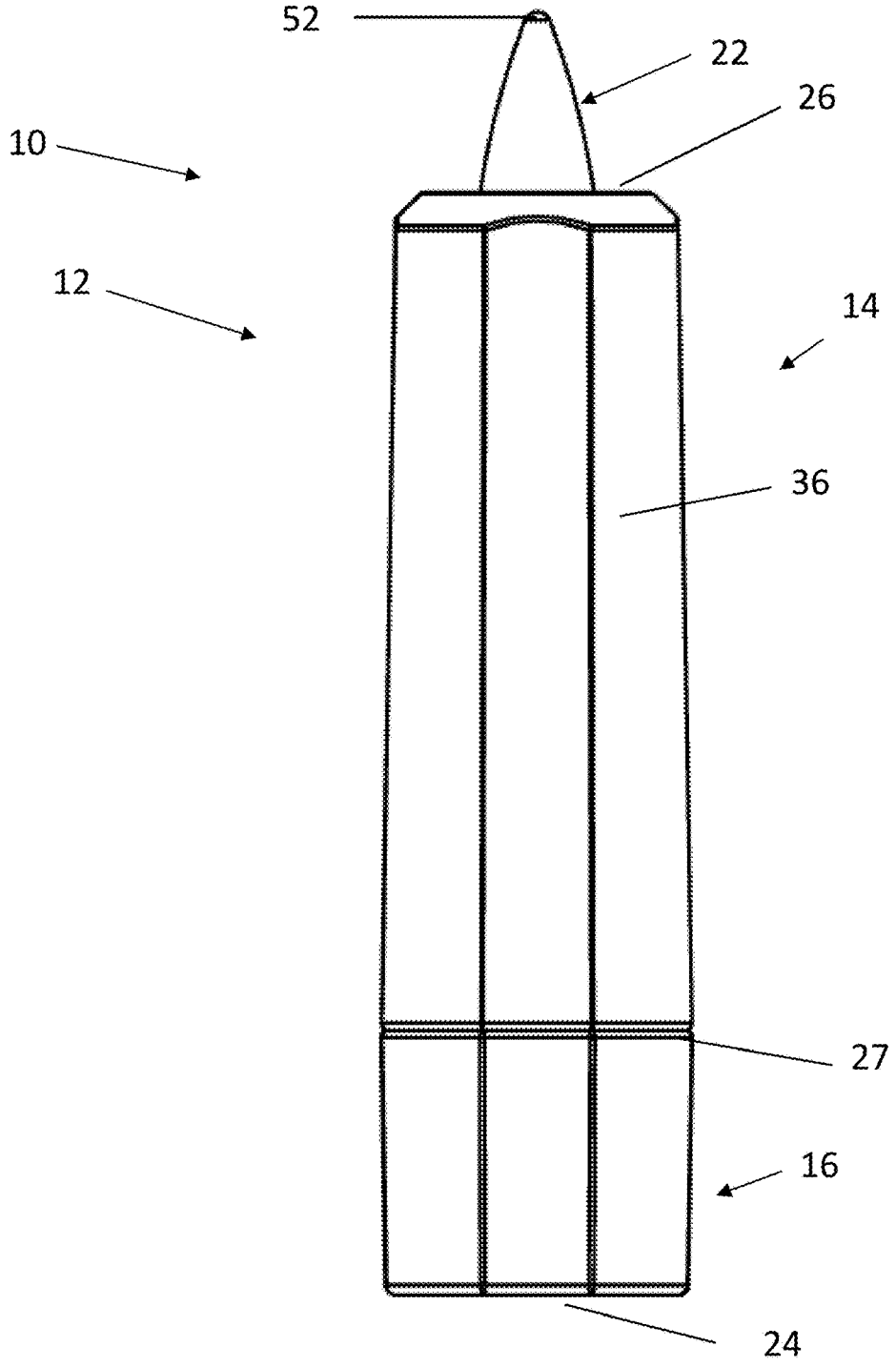
FIG. 6 is a rear elevation view of the arrangement shown in FIG. 5.
Figure 7:
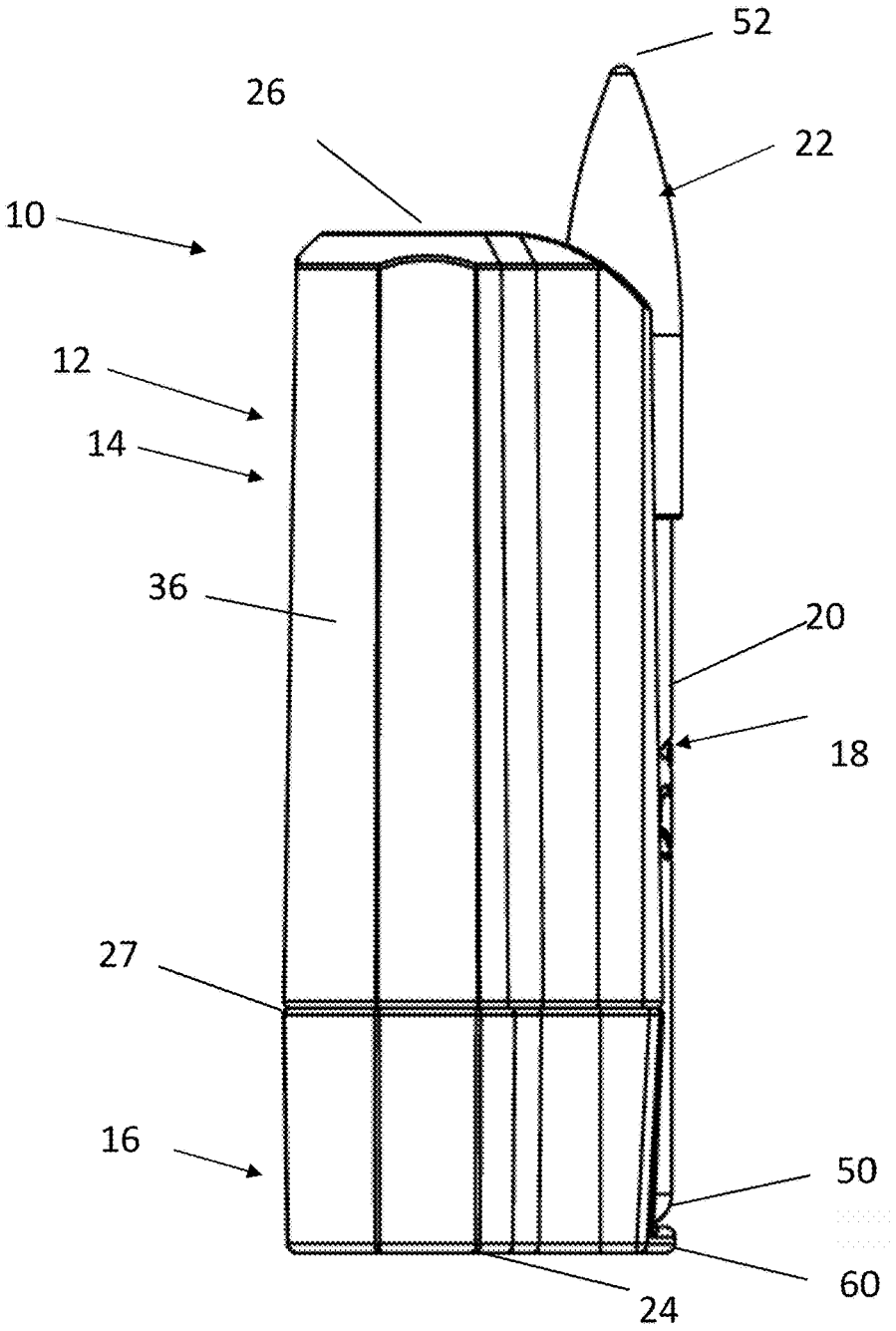
FIG. 7 is a side elevation view of the arrangement shown in FIGS. 5 and 6.
Figure 8:
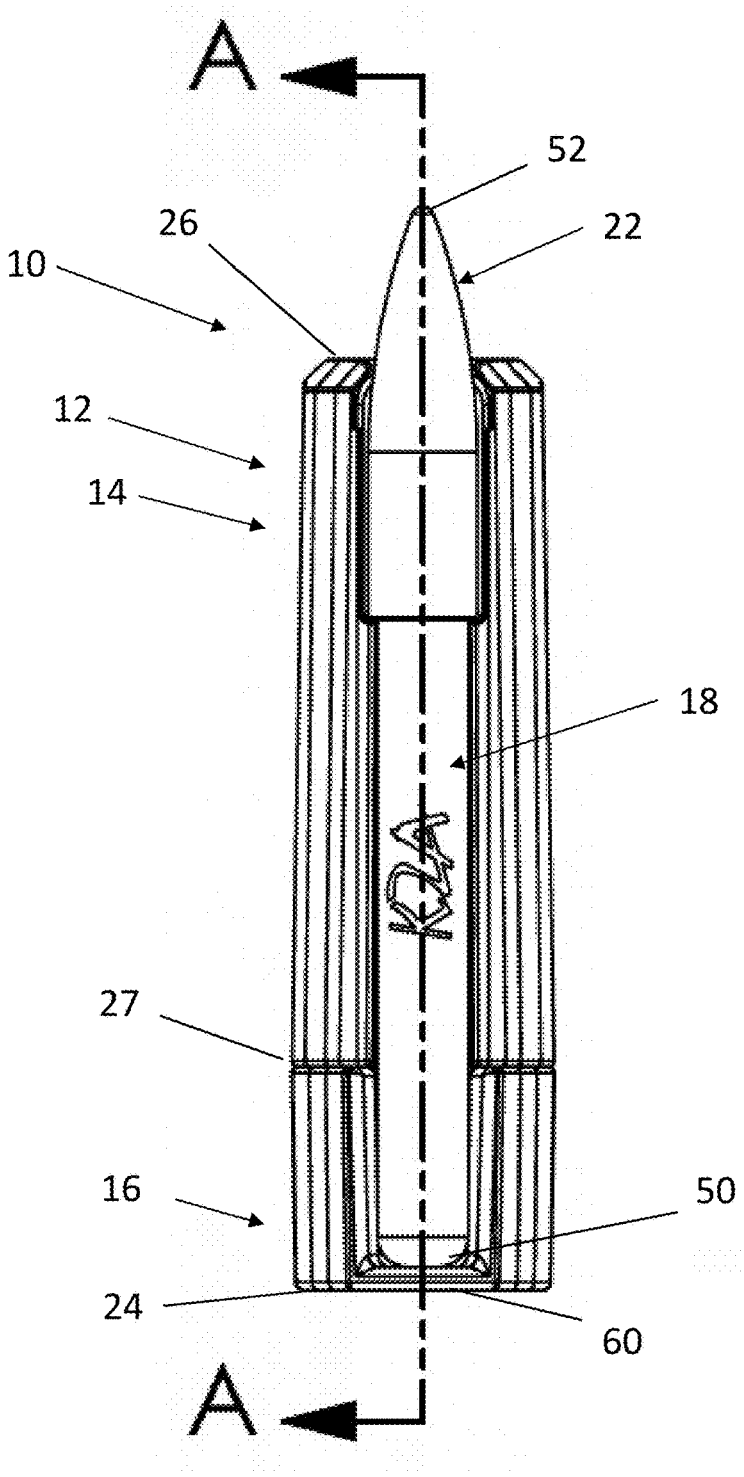
FIG. 8 is a front elevation view of the arrangement shown in FIGS. 5-7.
Figure 9:
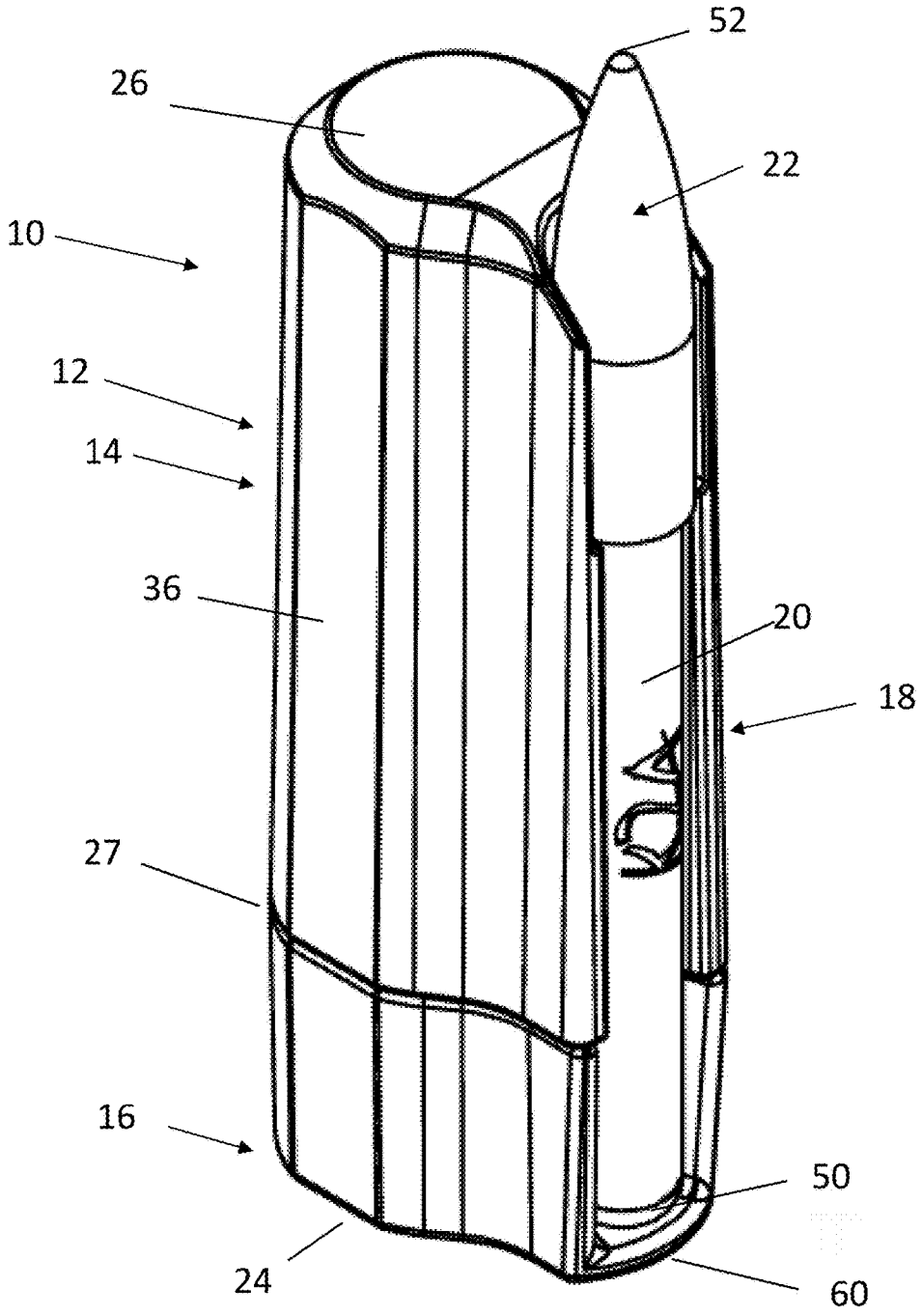
FIG. 9 is a front perspective view of the arrangement shown in FIGS. 5-8.
Figure 10:
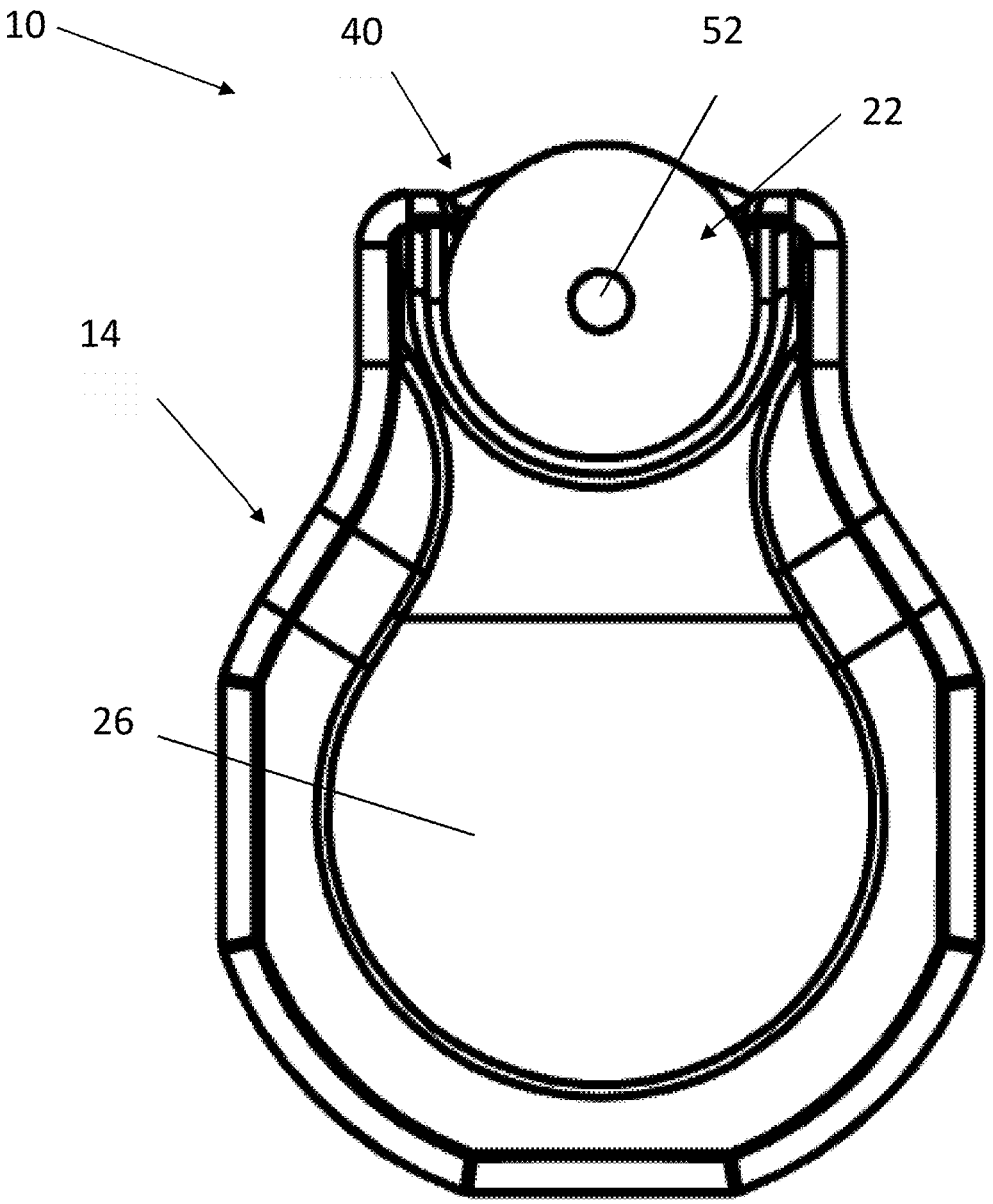
FIG. 10 is a top elevation view of the arrangement shown in FIGS. 5-9.
Figure 11:
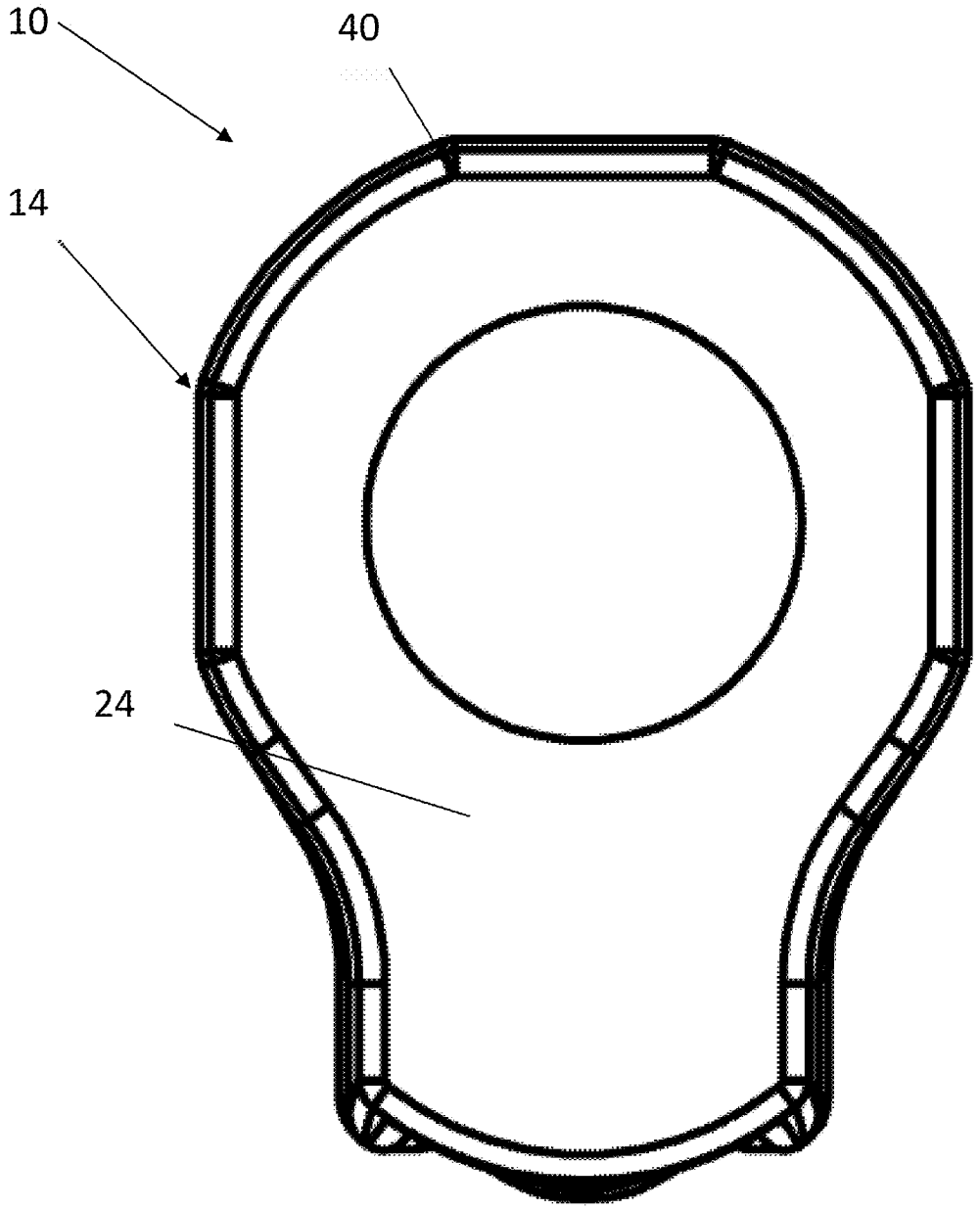
FIG. 11 is a bottom elevation view of the arrangement shown in FIGS. 5-10.
Figure 12:
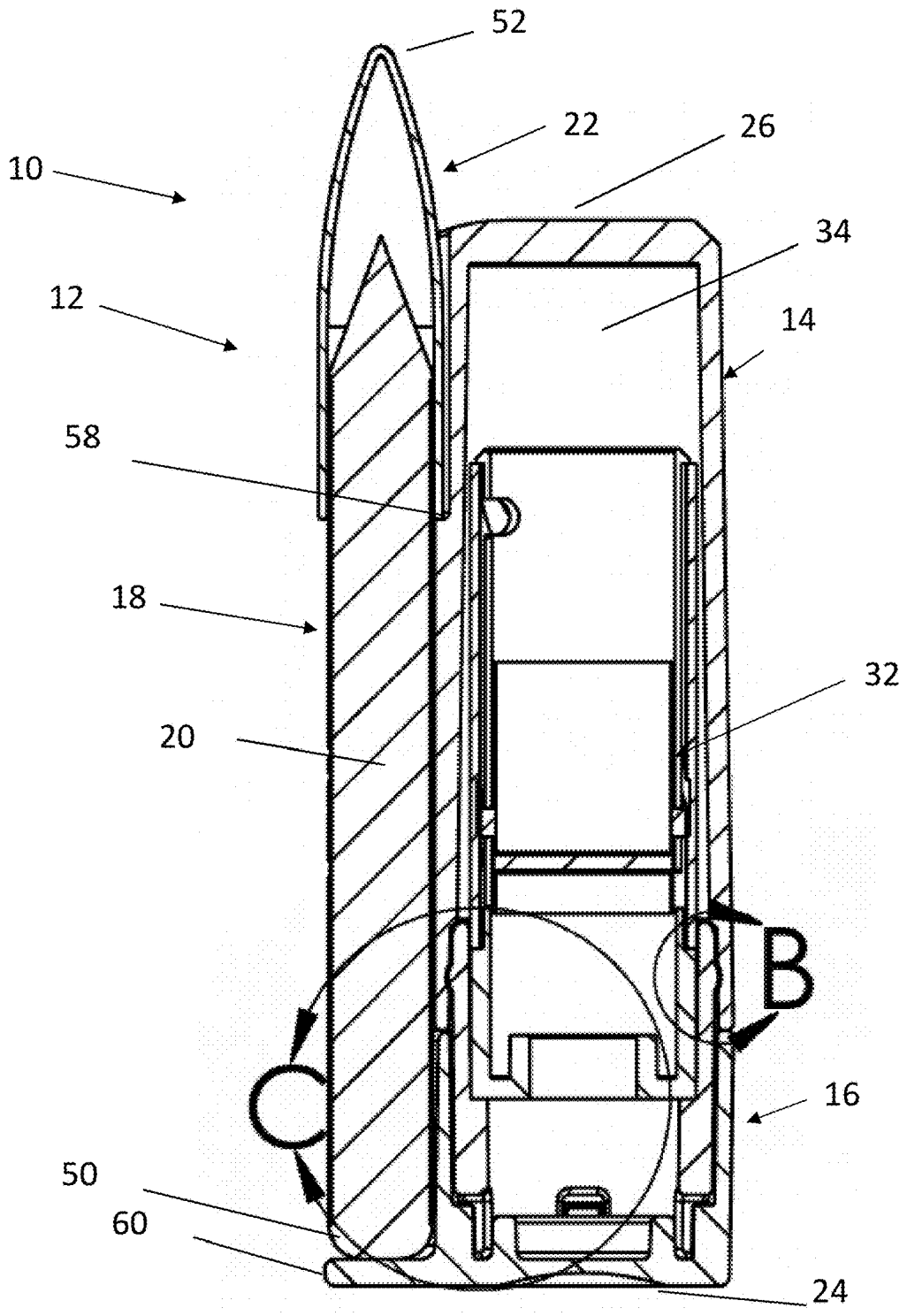
FIG. 12 is a side cut-away elevation view of the arrangement shown in FIGS. 5-11, the cut being made along line A as shown in FIG. 8.

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the invention(s). The following detailed description is, therefore, not to be taken in a limiting sense, and the scope of the invention is defined only by the appended claims, along with the full scope of equivalents to which such claims are entitled.

As used herein, the terminology such as vertical, horizontal, top, bottom, front, back, end and sides are referenced according to the views presented. It should be understood, however, that the terms are used only for purposes of description, and are not intended to be used as limitations. Accordingly, orientation of an object or a combination of objects may change without departing from the scope of the invention.

With reference to the figures, a makeup case system 10 (system 10) is presented that serves to keep two paired makeups together. As one example, a lipstick case 12 includes a cover 14, and a base 16 that are configured to receive a lip liner pencil 18, or other makeup pencil or other cylindrical makeup device, having a main body 20 and a cap 22. While a lipstick case 12 is shown herein, the system 10 and teachings herein are not so limited and reference to and depiction of a lipstick case 12 with associated pencil 18 is merely one of countless examples. As such, any form of makeup or combinations of makeup may be used with system 10 and is hereby contemplated for use.

Lipstick case 12 is formed of any suitable size, shape and design. In the arrangement shown, in FIG. 15, lipstick case 12 extends in a generally elongated manner from a lower end 24 to an upper end 26. Base 16 is positioned at lower end 24 and extends upward a distance before terminating at a seamline 27 where the upper end of base 16 connects to the lower end of cover 14. Cover 14 extends upward from base 16 until terminating at upper end 26.

A lipstick tube 28 is connected to and extends upward out of the upper end of base 16. In the arrangement show, lipstick tube 28 is generally cylindrical in shape and includes a hollow center that holds lipstick 30 therein. Lipstick tube 28 also includes a deployment mechanism 32 (not shown in detail).

Deployment mechanism 32 is formed of any suitable size, shape and design and is positioned within and between base 16 and lipstick tube 28. Deployment mechanism 32 serves to selectively raise and lower lipstick 30. In one arrangement, base 16 is rotated in one direction relative to lipstick tube 28 the lipstick 30 is deployed; in contrast as base 16 is rotated in a second direction, opposite the first direction relative to lipstick tube 28, the lipstick 30 is retracted. In this way, using the base 16, lipstick tube 28 and deployment mechanism 32 the user can control lipstick 30.

Cover 14 includes a generally hollow interior 34 that fits over and receives lipstick tube 28 and lipstick 30 therein. In this way, when cover 14 is placed on base 16, lipstick tube 28 and lipstick 30 are held within the hollow interior 34 of cover 14 and protected from the environment thereby preserving the life of lipstick 30.

In the arrangement shown in FIG. 15, as one example, when viewed from above or below, cover 14 and base 16 have a generally square or rectangular peripheral shape having a plurality of sidewalls 36 connected to one another at corners 38. In the arrangement shown, as one example, a holder 40 is positioned at or in one of the corners 38. Placing holder 40 in a corner 38 provides the maximum amount of room within cover 14 and base 16 for lipstick tube 28, lipstick 30 and deployment mechanism 32. However, it is hereby contemplated that holder 40 may be placed in any portion of cover 14 and/or base 16 including any portion of any sidewall 36, and is not limited to use in a corner 38.

Holder 40 is formed of any suitable size, shape and design and serves to selectively receive and hold pencil 18 therein. In the arrangement shown, as one example, when viewed from above or below, holder 40 is a generally semi-circular recess positioned within a corner 38. However any other shaped recess is hereby contemplated for use, such as square, rectangular, oval or the like that are configured to receive any shaped pencil 18.

Figure 15:
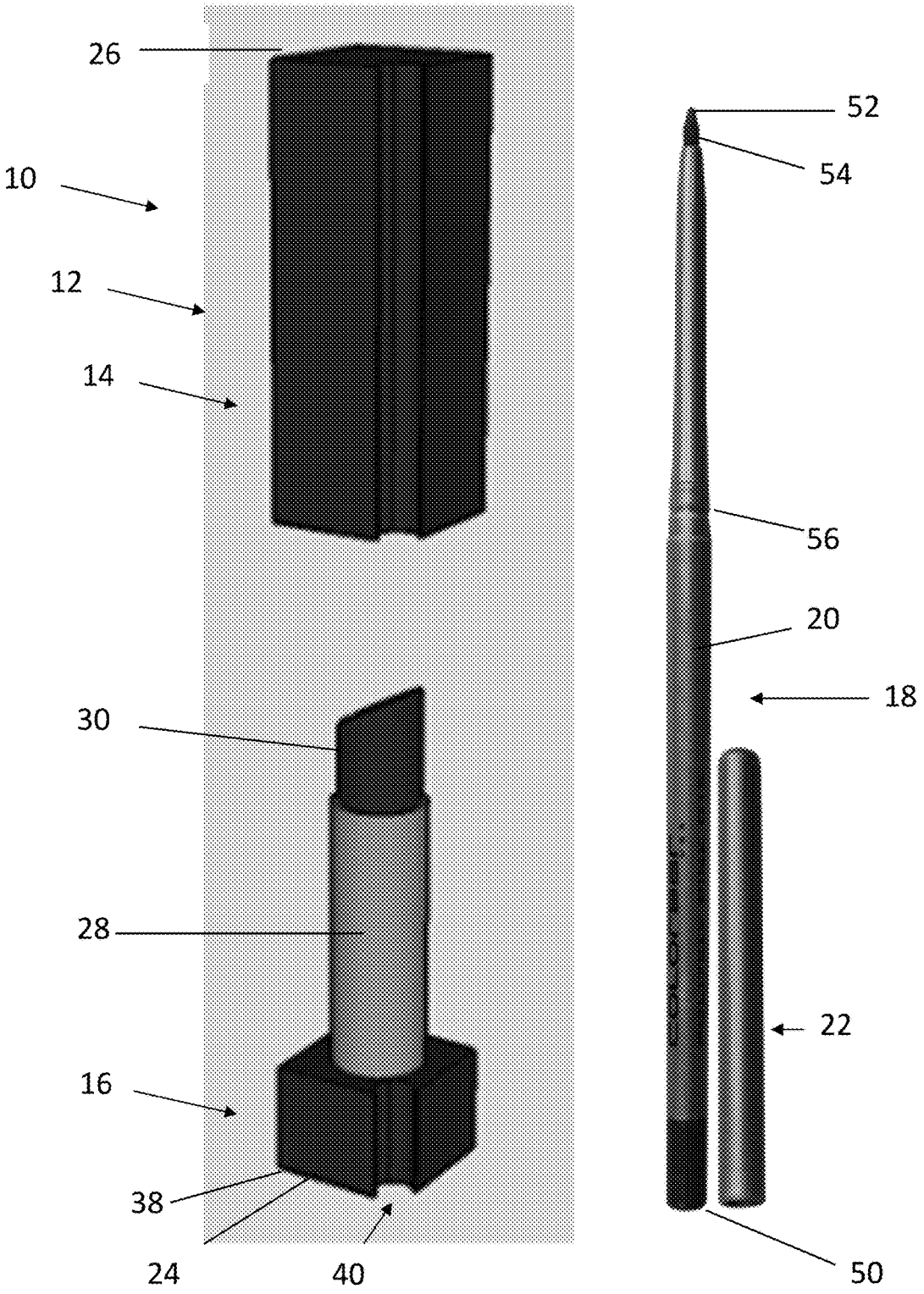
FIG. 15 a perspective view of an alternative embodiment of a makeup case system, the system showing the cover removed from the base, and the pencil removed from the holder in the cover and the base, the view also showing the lipstick deployment mechanism held within the cover and the base.
Figure 17:
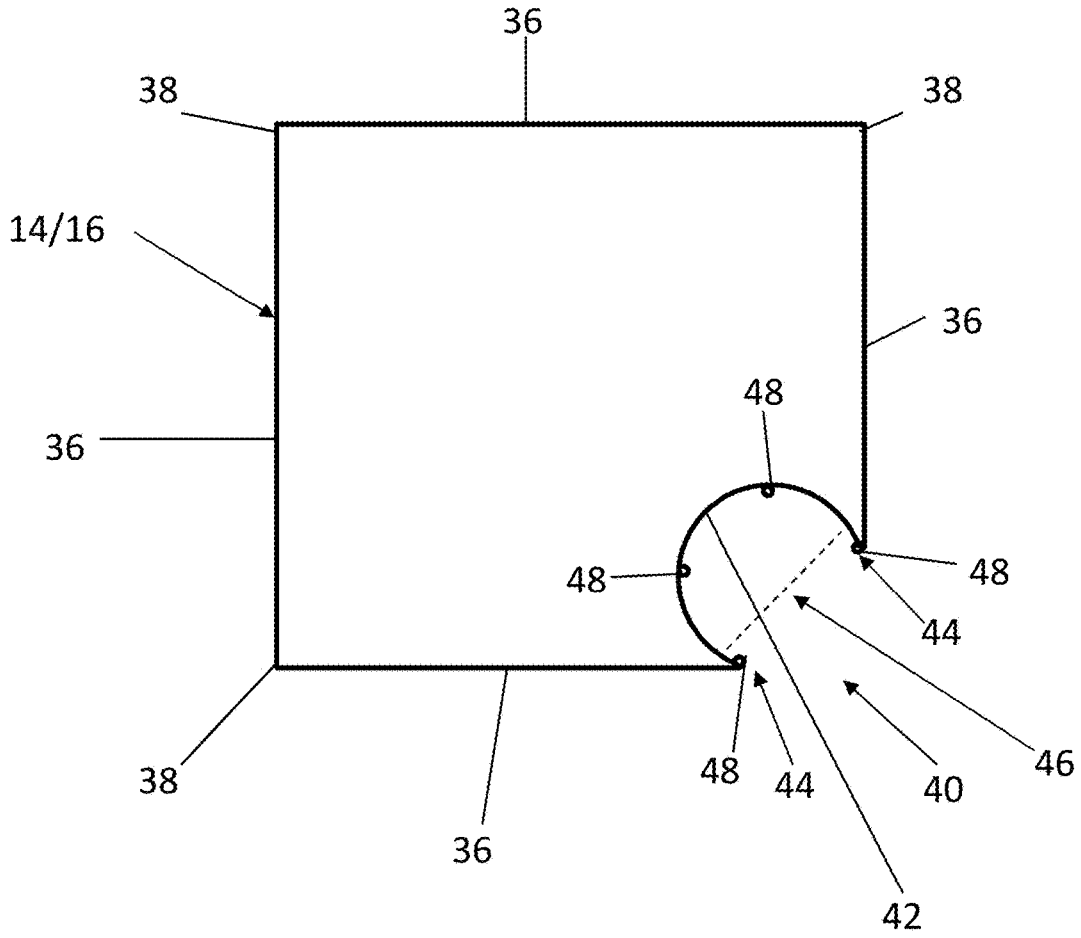
FIG. 17 is a plan view, from the top or bottom, the view showing an exemplary embodiment of the holder, in this arrangement the cover and the base have a generally square or rectangular surface, and the holder is positioned in a corner of the cover and/or base.
Figure 18:
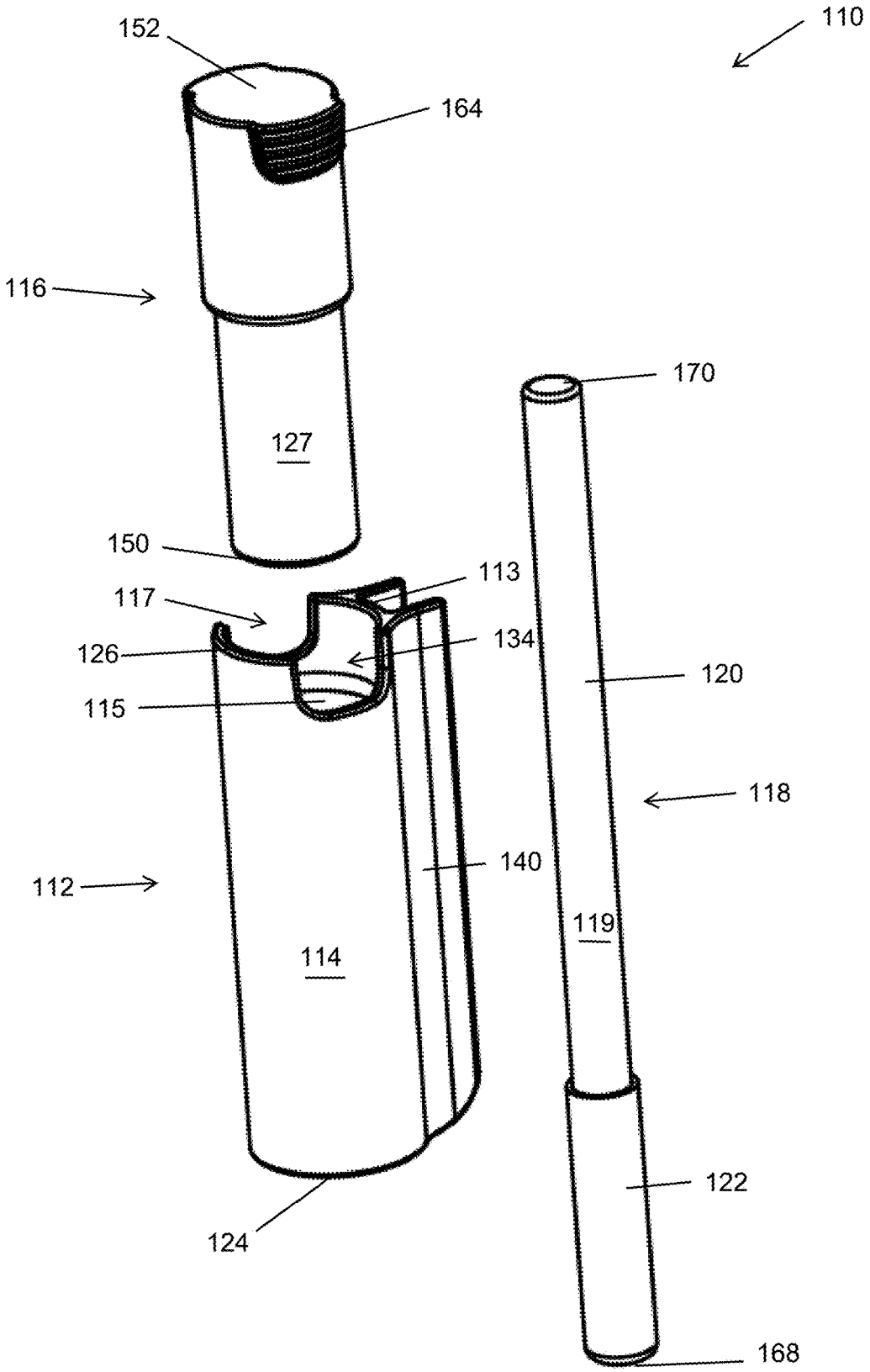
FIG. 18 is a perspective front view of a lipstick case system, the system showing the base removed from the cover, and the pencil removed from the holder of the cover.
Figure 19:
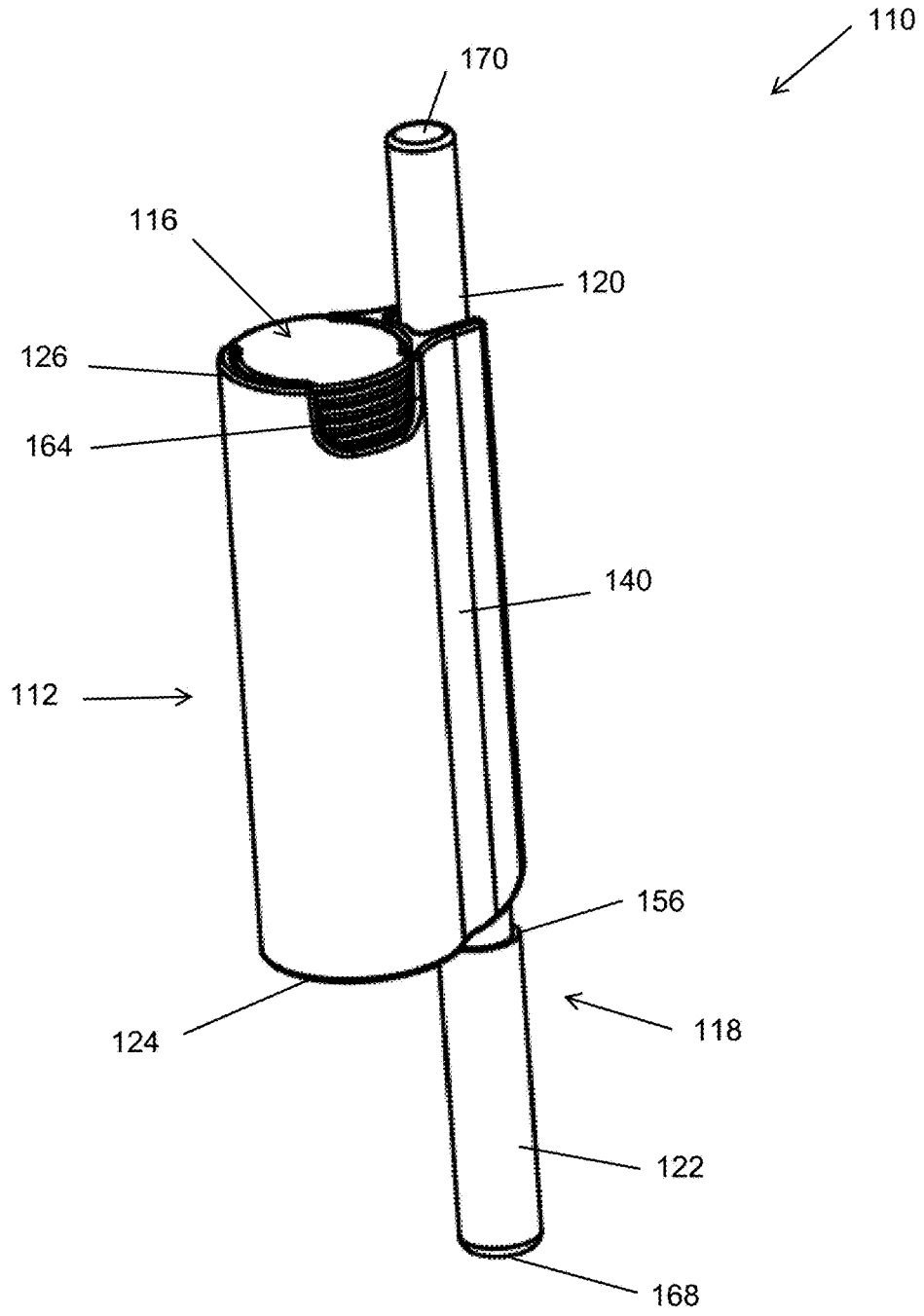
FIG. 19 is a perspective front view of a lipstick case system, the system showing the base inserted into the cover, and the pencil inserted in the holder of the cover.
Figure 20:
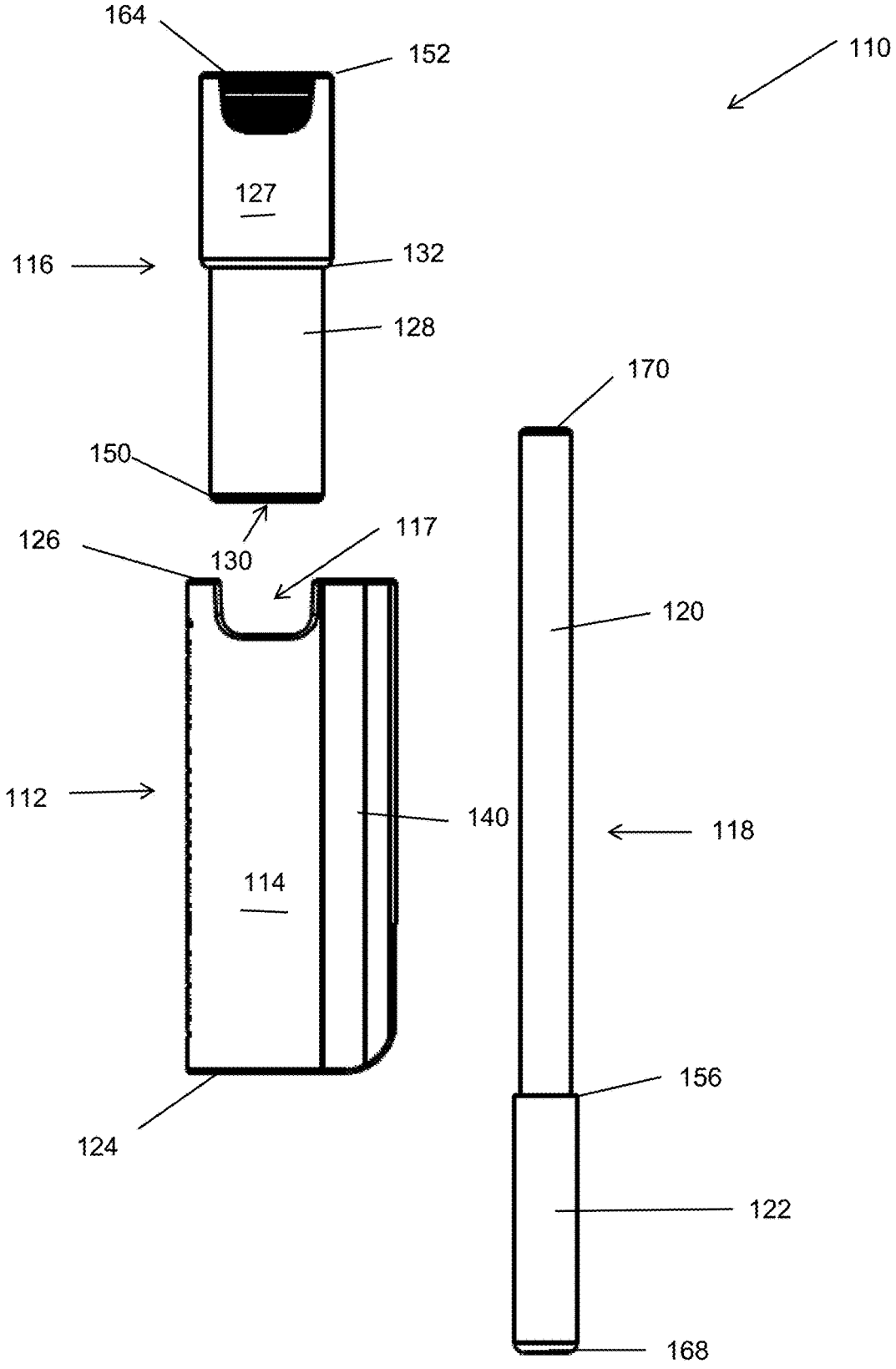
FIG. 20 is a front elevation view of the arrangement shown in FIG. 18.

More specifically, with reference to FIGS. 15 and 17, holder 40 is formed of a semi-circular center wall 42 that terminates in a pair of opposing lips 44 that intersect with adjacent sidewalls 36. To hold pencil 18 therein, the semi-circular center wall 42 is sized and shaped to receive a pencil 18 therein within close and tight tolerances. In one arrangement, when pencil 18 is in place within holder 40 the generally cylindrical exterior surface of pencil 18 is held in frictional engagement against and/or within the semi-circular center wall 42.

To hold pencil 18 within holder 40, lips 44 are positioned in a slightly over-center position. That is, the maximum diameter of pencil 18 is slightly larger than the distance between lips 44. Or, said another way, lips 44 extend past or are positioned past the maximum diameter, or the centerline 46 (shown in dashed lines) of the circle that forms the semi-circular center wall 42. By having lips 44 extend past centerline 46, this causes lips 44 to elastically deflect away to allow entry of pencil 18 into holder 40. Once pencil 18 is past lips 44, lips 44 again elastically move back to their original position. Because, lips 44 extend past centerline 46, lips 44 hold pencil 18 within holder 40.

In one arrangement, cover 14 and base 16 are formed of a single continuous material, such as a plastic material such as ABS plastic, acrylic, polycarbonate, nylon, PVC, composite or the like. In this arrangement, the dimensions of cover 14, base 16 and holder 40, especially lips 44, are precisely sized and shaped and designed to provide the proper amount of give or flex to allow entry and exit of pencil 18 within holder 40. In one arrangement, the thickness of lips 44 vary along their length to facilitate easy entry and exit of pencil 18 into and out of holder 40. To facilitate easier insertion and removal of pencil 18 within holder 40, in one arrange a dual-durometer arrangement is used. That is, in this arrangement, the material of the majority of cover 14 and base 16 are formed of one material, and the material that forms holder 40 and/or lips 44, or some portion thereof, is formed of a second material that is softer, or more flexible or more compressible than the first material. As one example, the majority of cover 14 and base 16 are formed of a generally rigid plastic material, nylon, PVC or composite or the like whereas the holder 40 and/or the lips 44 are formed of a semi-flexible or flexible material or more-compressible material such as rubber, synthetic rubber, gel, foam, or the like. In this way, the flexible material deflects more easily to allow entry and exit of pencil 18 within holder 40. In addition, the flexible material of holder 40 and/or lips 44 tends to provide additional grip or increased slip-resistance which is beneficial as it tends to prevent pencil 18 from unintentionally sliding out of holder 40.

In addition, using a flexible or semi-flexible or somewhat malleable material for holder 40 and/or lips 44 helps to provide additional give and flexibility to accommodate variation between pencils 18 and variation between manufactures of pencils 18. That is, many pencils 18 presently on the market are formed of a relatively standard size, however there may be substantial size variation between pencils 18 and between manufactures of pencils 18. The configuration of the system 10 increases the robustness of the design and helps to reduce the potential of a particular pencil 18 not fitting within holder 40. As such, the configuration of the system 10 allows a user to pair most any pencil 18 with lipstick 30. This allows ease of customization as no prior system allows consumers to so easily attach a pencil 18 to a lipstick 30 thereby providing customized pairings.

In addition, using a second material for holder 40 and/or lips 44 allows for use of a material that has a higher coefficient of friction as compared to the material used for the exterior surface of lipstick case 12. In this arrangement, the material used for the exterior surface of lipstick case 12 has a low coefficient of friction thereby allowing the lipstick case 12 to slide easily within a user's pocket, purse or makeup bag; whereas the material used for holder 40 and/or lips 44 is formed of a material that has a higher coefficient of friction thereby helping to hold onto pencil 18 and helping to reduce or prevent unintentional separation thereof.

To provide additional give and flexibility to holder 40, one or a plurality of compressible members 48 are placed within the semi-circular center wall 42 of holder 40 and/or on the end of lips 44. Compressible members 48 are formed of any suitable size, shape and design and serve to provide additional flexibility and give to holder 40. In one arrangement, as is shown, a plurality of compressible members 48 are spaced across the semi-circular center wall 42 and extend inward into holder 40. In one arrangement, compressible members 48 are formed of a compressible material, flexible material or semi-flexible material such as rubber, synthetic rubber, rubber foam, or the like. Being flexible or compressible allows compressible members 48 to compress when a pencil 18 is placed within holder 18. This allows for holder 40 to be more accommodating or to accept pencils 18 having a broader array of sizes and shapes thereby making the design more robust in nature. In the arrangement shown, compressible members 48, when viewed from above or below appear to be rounded and extend into holder 40 a limited distance. These compressible members 48 can take on any shape, such as fingers, flanges, feet or the like. The compressible members 48 can extend the entire length of holder 40 from lower end 24 to upper end 26, or alternatively they may be shorter and be formed of a plurality of buttons that protrude out into holder 40 intermittently along the length of holder 40. In yet another alternative arrangement, the entire surface of holder 40, and/or semi-circular center wall 42 may be formed of or coated with a compressible material or flexible material which will provide holder 40 additional give and flexibility.

System 10 also includes a pencil 18. Pencil 18 is formed of any suitable size, shape and design. In the arrangement shown, as one example, where holder 40 includes a generally elongated cylindrical opening in cover 14 and base 16, pencil 18 is a generally cylindrical member that extends from a lower end 50 to an upper end 52. Removable cap 22 covers upper end 52 of pencil 18. In the arrangement shown, main body 20 of pencil 18 has a generally cylindrical exterior surface. When cap 22 is removed, the upper end 52 of pencil 18 terminates in a tip 54 that is used in the makeup application process. The main body 20 of pencil 18 includes a step 56 at the point where the lower end of cap 22 covers main body 20, among other cooperative features that help to hold cap 22 and main body 20 together while allowing for selective removal of cap 22.

In Operation: A user selects their desired color of lipstick 30 held within lipstick case 12. Next the user selects the appropriate color of lip liner or eye liner or appropriate brush, which is in the form of a pencil 18. The user applies the lipstick 30 by grasping lipstick case 12, removing cover 14 from base 16 by pulling cover 14 away from base 16 and exposing lipstick tube 28. Next, the user rotates base 16 with respect to lipstick tube 28 to deploy lipstick 30. Next, the user applies lipstick 30 and when done retracts lipstick 30 within lipstick tube 28 by again rotating base 16 with respect to lipstick tube 28. Next, the user places cover 14 back over the lipstick 30 and lipstick tube 28 thereby protecting lipstick 30.

Similarly, the user applies and eyeliner or lip liner using pencil 18. In the arrangement, where pencil 18 includes a cap 22, cap 22 is removed, the makeup is applied using tip 54. When applied, the cap 22 is replaced over tip 54 until it engages step 56 and is held in place thereby protecting tip 54.

Now that the lipstick 30 has been paired with the lip liner or eyeliner or brush of pencil 18 to prevent unintentional separation of the lipstick 30 and the pencil 18 the system 10 is used. That is, the user aligns the main body 20 or any portion of pencil 18 with the holder 40. Once the elongated pencil 18 is aligned with the elongated recess that is the holder 40, the user applies pressure to the pencil 18 forcing the pencil 18 into the opening of holder 40. That is, the user forces the pencil 18 into the holder 40 from the side of the lipstick case 12. As the user applies pressure to pencil 18, because the lips 44 extend past centerline 46, or are narrower than the maximum diameter of holder 40 and pencil 18, the lips 44 frictionally engage the exterior surface of pencil 18. As pressure is applied, these lips 44 elastically deflect away from one another thereby allowing pencil 18 to enter and snap into holder 40.

Once pencil 18 is inserted within holder 40, the lips 44 again elastically deflect inward toward one another back to their original position or close to their original position. Again, because these lips 44 extend past centerline 46 these lips 44 hold pencil 18 within holder 40. In this position, the exterior surface of pencil 18 is in generally flat, flush and frictional engagement with the semi-circular center wall 42.

In the arrangement where compressible members 48 are positioned within holder 40, or at the end of lips 44, compressible members 48 deform to receive pencil 18 and accommodate any size variations between holder 40 and pencil 18. Compressible members 48 also help to prevent pencil 18 from unintentionally sliding out of holder 40 due to their compressible and high-friction nature.

Alternatively, the pencil 18 may be inserted by inserting the lower end 50 of the pencil 18 within the upper end 26 of holder 40 and forcing the pencil 18 downward with respect to the lipstick case 12. In doing so, a similar process occurs to that described above, that is the lips 44, and/or holder 40 flexes to accommodate the pencil 18 and frictionally holds the pencil 18 therein once in place.

In this way, the lipstick case 12 system 10 allows for the insertion (and removal) of the pencil 18 within holder 40 from both the side as well as from above. This provides improved flexibility of use and convenience.

Once pencil 18 is inserted within holder 40 it is held in place and resists unintentional removal from holder 40. The frictional engagement between holder 40 and pencil 18 helps to hold pencil 18 in place within holder 40. If the arrangement where a compressible material, compressible members 48 or a flexible material is placed within holder 40 or forms lips 44, this material further helps to hold pencil 18 within holder 40.

Once combined, the user can store the combined lipstick case 12 and pencil 18 without fear that the two will be separated. When it is time to apply the paired makeups again or reapply the paired makeups, time will be saved as the pencil 18 will be held in place within holder 40. This prevents the user from having to search for and re-pair the two previously paired makeups.

To remove the pencil 18 from the holder 40, the user grasps the lipstick case 12 in one hand and the pencil 18 in the other hand. The user then applies force greater than the force of frictional engagement between the pencil 18 and the holder 40. The pencil 18 may be removed by pulling the pencil 18 upward with respect to the makeup case 12, or by forcing the pencil 18 sideways with respect to lipstick case 12. As force is applied to the pencil 18, the compressible members 48 and/or lips 44 deflect and allow passage of the pencil 18 out of holder 40. In this way, the lipstick case 12 system 10 allows for removal of the pencil 18 within holder 40 from both the side as well as from above. This provides improved flexibility of use and convenience.

Additional Holders: While, in the arrangement shown, a single holder 40 is included within cover 14 and base 16, additional holders 40 are hereby contemplated. That is, two holders 40 are hereby contemplated for use, such as in the arrangement where in a lipstick 30 is paired with an eyeliner pencil 18 and a lip liner pencil 18 and brush. In addition, three holders 40 are contemplated, four holders 40 are hereby contemplated for use, or more holders 40. In the arrangement wherein there are multiple holders 40 they may be placed in adjacent corners, opposite corners or in any other portion of lipstick case 12.

Figure 16:
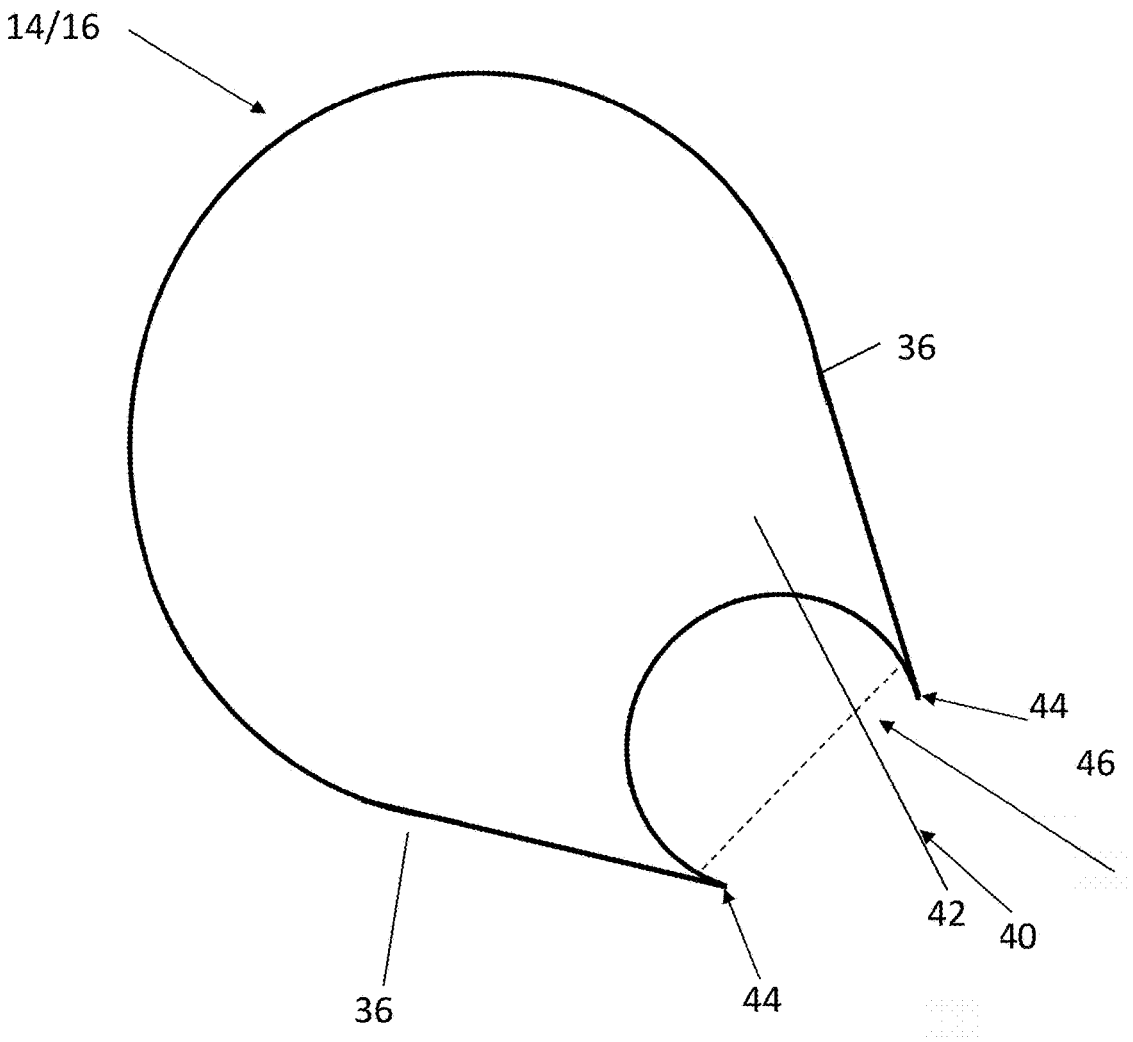
FIG. 16 is a plan view, from the top or bottom, the view showing an exemplary embodiment of the holder, in this arrangement the cover and base have a generally rounded exterior surface.

Different Shapes: While, in the arrangement shown, when viewed from above or below lipstick case 12 is formed of a square or rectangular shape. However, any other shape is hereby contemplated for use. In one arrangement, with reference to FIG. 16, a lipstick case 12 is viewed from above or below. In this arrangement, lipstick case 12 is generally circular in shape when viewed from above or below and includes an extension off to one side that houses holder 40. This arrangement reduces the overall size of lipstick case 12 and provides a different aesthetic appearance. A similar arrangement is hereby contemplated for two or three holders 40.

Holder Configuration: In one arrangement, holder 40 extends continuously from the upper end 26 of lipstick case 12 to the lower end of lipstick case 28. In this arrangement, the holder 40 is positioned in both the cover 14 and the base 16. In an alternative arrangement, holder 40 is present in only one of the cover 14 or base 16.

With reference to FIGS. 1-14 another embodiment of the system is presented. In this arrangement, the lipstick case has a smooth and rounded exterior surface. This arrangement also, shows the holder 40 positioned in both the cover 14 and the base 16. As is seen in FIG. 1, a step 58 is present in the upper portion of holder 40 that is positioned to engage or index the lower end of cap 22 of pencil 18. In this way, step 58 stops the downward progression of pencil 18 within holder 40, or said another way, the presence of step 58 helps to provide consistent positioning of pencil 18 within holder 40. The portion of holder 40 above step 58 has a larger diameter than the portions of holder 40 below step 58. This larger diameter provides room to receive cap 22 of pencil therein. In this arrangement, the entirety of pencil 18 may be held within holder 40. That is, the upper end 52 and lower end 50 of pencil 18 are aligned with or within the upper end 26 and lower end 24 of lipstick case 12. Alternatively, as is shown, the upper end 52 of pencil 18 may extend past the upper end 26 of cover 14 a slight distance.

In addition, as consumers sharpen pencil 18 the pencil 18 gets shorter. The use step 58 allows the continued and convenient use of the system 10 when the pencil 18 gets short. That is, regardless how short pencil 18 gets, the step 58 engages the bottom edge of cap 22 thereby ensuring that the pencil 18 does not slide down within holder 40, which makes it difficult to remove pencil 18. This allows for consistently easy removal of pencil 18 even when it gets short.

Also shown in this arrangement is a flange 60 positioned at the lower end 24 of holder 40. This flange 60 closes the bottom end 24 of holder 40 and provides a ledge to place the lower end 50 of pencil 18 there against when inserting pencil 18 within holder 40. This provides quick and easy alignment of pencil 18 and helps the insertion process. Also, by covering the lower end of holder 40, this helps to prevent unintentional separation of the pencil 18 from the holder 40 as objects are prevented from getting between the lower end of pencil 18 and holder 40. In other arrangements, the flange 60 is not present and allows for an open lower end 24.

Also shown in this arrangement, is that the lower end of lipstick tube 28 is fits within the hollow interior 34 of base 16. In one arrangement, the lower end of lipstick tube 28 is removable from the hollow interior 34 of base 16; whereas in an alternative arrangement the lower end of lipstick tube 28 is permanently affixed within the hollow interior 34 of base 16 by adhesives, gluing, welding, a permanent snap-fit feature or the like.

Figure 13:
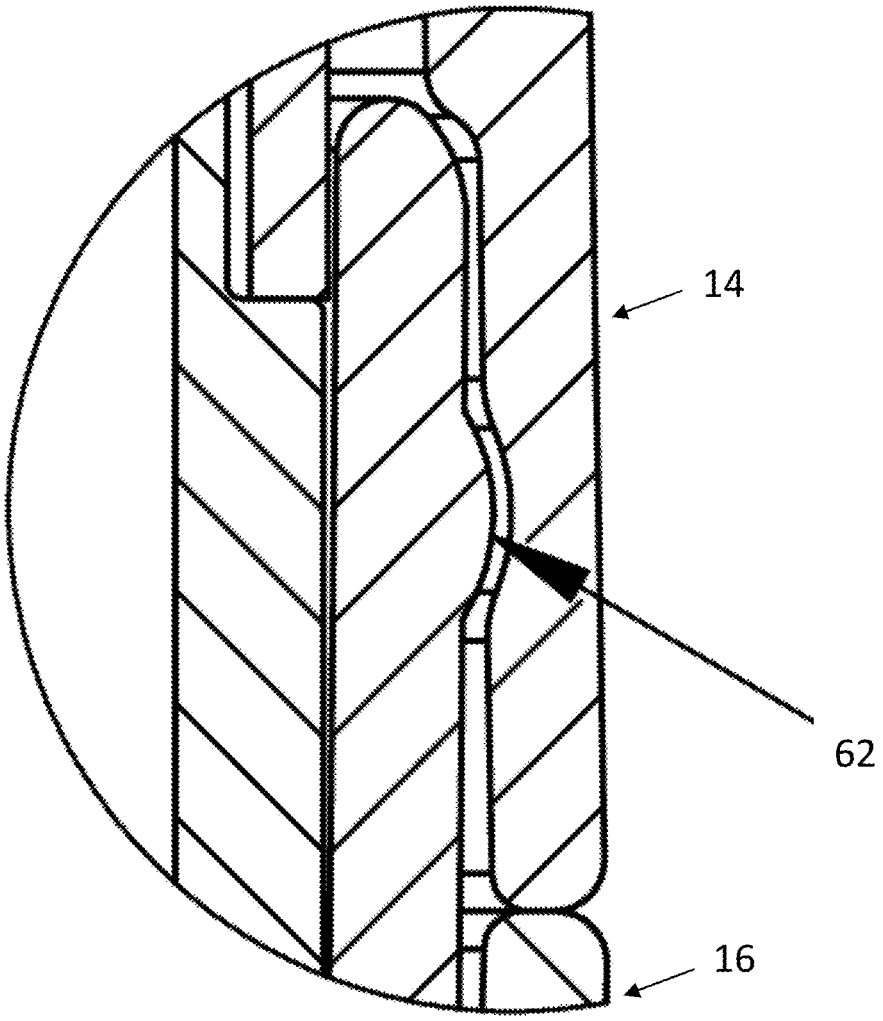
FIG. 13 is a close-up cut-away elevation view of the view shown within circle B in FIG. 12.

In the close-up view of FIG. 13, a detent 62 is shown in the lower end of cover 14 and the lower end of lipstick tube 28. Detent 62 is formed of any suitable size, shape and design and is configured to help hold the cover 14 and base 16 together and prevent unintentional separation while allowing for separation when desired. In the arrangement shown, detent 62 is a ring or bulge in the lower end of lipstick tube 28 that fits within and is received by a groove or recess in the lower end of cover 14 when cover 14 is in a fully closed position. When closing or opening cover 14 the user must overcome the frictional engagement of detent 62, and when in a closed position, the engagement of the ring in the lipstick tube 28 within the groove of the cover 14 helps to hold the two components together.

Figure 14:
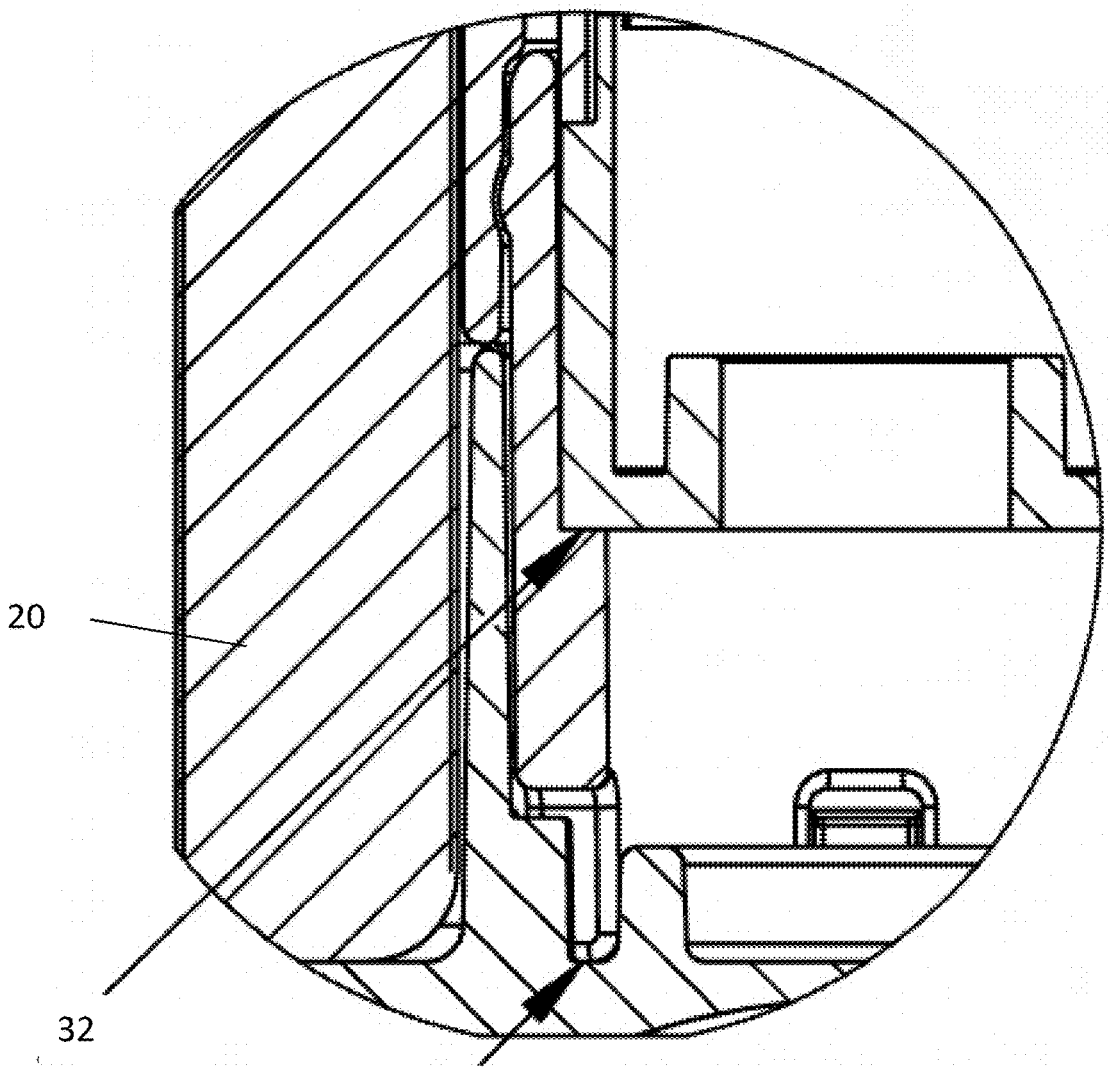
FIG. 14 is a close-up cut-away elevation view of the view shown within circle C in FIG. 12.

In the close-up view of FIG. 14, the lower end 50 of pencil 18 is in flat and flush engagement with the upper surface of flange 60 when pencil 18 is fully in place within holder 40. Also shown in this arrangement are portions of the deployment mechanism 32 and the cooperative arrangement between the lower end of lipstick tube 28 within base 16.

Other Makeup Cases: While a lipstick case 12 is presented herein, the invention is not so limited. That is, it is hereby contemplated that the system 10 may be used with any two types of makeup, or with a makeup case and any other objects. Examples include, a powder container and a powder brush; a mascara container and an eyeliner pencil, or the like combinations.

Alternative Arrangement:

In an alternative embodiment, with reference to FIGS. 18-28, a lipstick case system 110 (system 110) is presented that serves to keep two paired makeups together. As one example, system 110 includes a cover 112, that is configured to receive a base 116 and a pencil 118, or other makeup pencil and/or other makeup base or other cylindrical makeup device, having a main body 20 and/or a cap 22. While a lipstick case system 110 is shown herein, the system 110 and teachings herein are not so limited and reference to and depiction of a lipstick case 110 with associated base 116 and associated pencil 118 is merely one of countless examples. As such, any form of makeup or combinations of makeup may be used with system 110 and is hereby contemplated for use.

Cover 112 is formed of any suitable size, shape and design. In the arrangement shown, as one example, in FIG. 18, cover 112 extends in a generally elongated manner from a lower end 124 to an upper end 126. Cover 112 is generally circular in shape when viewed from the top or the bottom with a holder 140 attached to the exterior surface 114 and extending outwardly therefrom. An opening 113 is positioned at the upper end 126 of cover 112 that connects to and provides access to hollow interior 134 in cover 112 that is configured to receive base 116 therein. Opening 113 is adjacent to a first-recess 117 at the upper end 126 which is designed to receive, house and hold at least one protrusion 164 of the base 116. In the arrangement shown, as one example, a pair of first-recesses 117 are positioned in the upper end 126 of cover 112, one on each side of cover 112.

System 110 also includes a base 116. Base 116 is formed of any suitable size, shape and design. Base 116 is generally cylindrical in shape and extends from a lower end 150 to an upper end 152. In the arrangement shown, as one example, where cover 112 includes an elongated recess 141 to insert a pencil 118, cover 112 includes an opening 113, adjacent to first-recess 117, on the upper end 126 of cover 112 to insert base 116.

In the arrangement shown, as one example, base 116 includes a lipstick tube 128 that is connected to and extends downward out of the upper end 152 of base 116. In the arrangement shown, lipstick tube 128 is generally cylindrical in shape and includes a hollow center that holds lipstick 130 therein. Lipstick tube 128 also includes a deployment mechanism 132 (not shown in detail).

Deployment mechanism 132 is formed of any suitable size, shape and design and is positioned within and between the upper end 152 of base 116 and lipstick tube 128. Deployment mechanism 132 serves to selectively raise and lower lipstick 130. In one arrangement, the lower portion of base 116 is rotated in a first direction relative to upper portion of base 116 so the lipstick 130 is deployed; in contrast as base 116 is rotated in a second direction, opposite the first direction relative to lipstick tube 128, the lipstick 130 is retracted. In this way, using the base 116, lipstick tube 128 and deployment mechanism 132 the user can control lipstick 130.

Cover 112 includes a generally hollow interior 134 that fits over and receives base 116 therein. In this way, when base 116 is inserted into cover 112, base 116 and/or the lipstick tube 128 and lipstick 130 are held within the hollow interior 134 of cover 112 and protected from the environment thereby preserving the life of lipstick 130 or other makeup housed within base 116.

In the arrangement shown in FIG. 28, as one example, when viewed from above or below, cover 112 and base 116, together, have a generally circular peripheral shape having a round outer wall and a holder 140 attached on the exterior of the cover 112. In the arrangement shown, as one example, a holder 140 is positioned at the exterior of cover 112. Placing holder 140 on the exterior surface of cover 112 provides the maximum amount of room within cover 112 to receive base 116. However, it is hereby contemplated that holder 140 may be placed in any portion of cover 112 and/or base 116 including any portion of the interior or exterior.

Holder 140 is formed of any suitable size, shape and design and serves to selectively receive and hold pencil 118 therein. In the arrangement shown, as in FIG. 28, as one example, when viewed from above or below, holder 140 is a generally semi-circular and/or rectangular recess. However any other shaped recess is hereby contemplated for use, such as square, rectangular, oval or the like that are configured to receive any shaped pencil 118.

Figure 21:
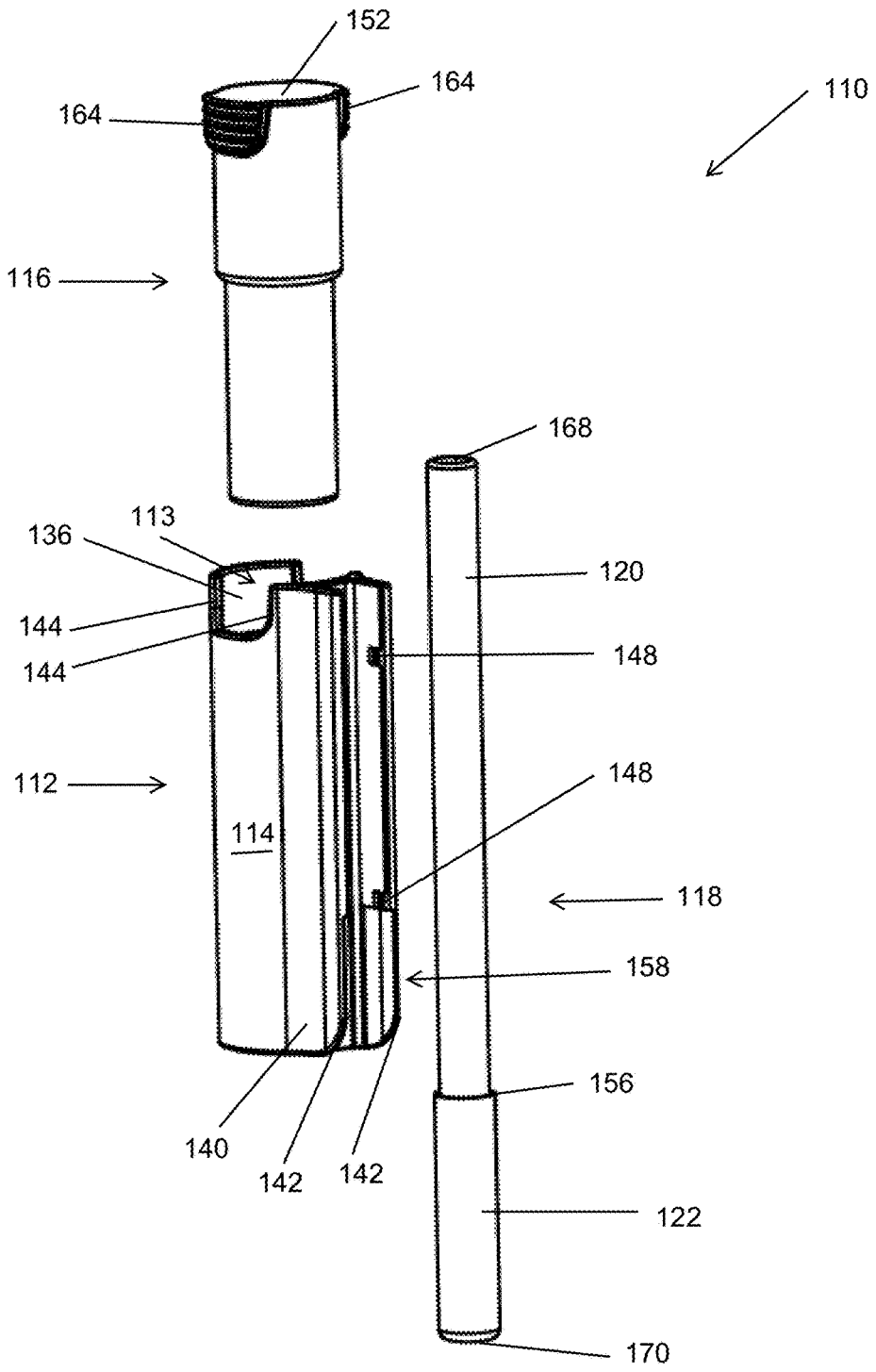
FIG. 21 is a perspective rear view of the arrangement shown in FIG. 18.
Figure 28:
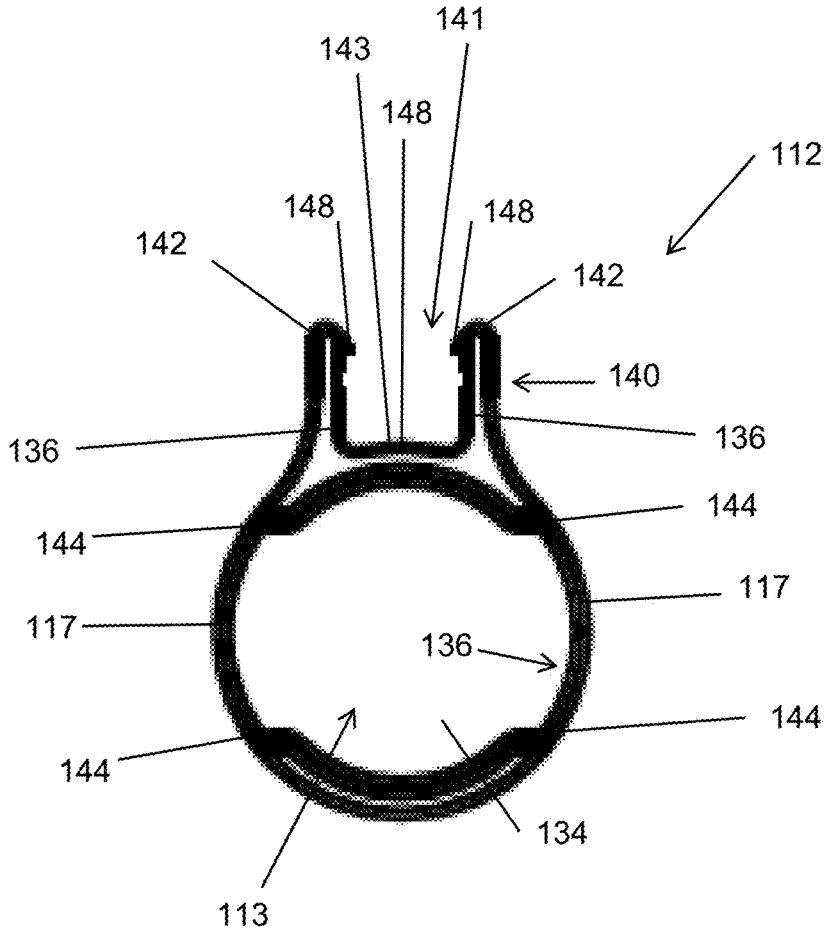
FIG. 28 is a top elevation view of a cover without a base or pencil shown.

More specifically, with reference to FIGS. 21 and 28, holder 140 is formed of a center wall 143 that terminates in a pair of opposing lips 142 that intersect with adjacent sidewalls 136. To hold pencil 118 therein, the center wall 143 is sized and shaped to receive a pencil 118 therein within close and tight tolerances. In one arrangement, when pencil 118 is in place within holder 140 the generally cylindrical exterior surface of pencil 118 is held in frictional engagement against and/or within the center wall 143.

To hold pencil 118 within holder 140, lips 142 are positioned in a slightly over-center position. That is, the maximum diameter of pencil 118 is slightly larger than the distance between lips 142, so that the lips 142 grip on the pencil 118 (note the centerline 147 (shown in dashed lines on FIG. 25)). And, lips 142 extend past or are positioned past the maximum diameter of pencil 118, or past the outward end of pencil 118 when pencil 118 is positioned within holder 140 thereby holding pencil 118 within holder 140. By having lips 142 extend past maximum diameter of pencil 118 and be narrower than the maximum diameter of pencil 118, this causes lips 142 to elastically deflect away to allow entry of pencil 118 into holder 140. Once pencil 118 is past lips 142, lips 142 again elastically move back toward their original position thereby gripping pencil 118. In this way, lips 142 hold pencil 118 within holder 140.

In an alternative arrangement, to hold pencil 118 within holder 140, the pencil 118 is slid in from the lower end or the upper end of the holder 140. The lips 142 are positioned such that they tightly and frictionally holding pencil against the center wall 143 and within holder 140.

In one arrangement, cover 112 and base 116 are formed of the same material, such as a plastic material such as ABS plastic, acrylic, polycarbonate, nylon, PVC, composite or the like. However any other material is hereby contemplated for use. In this arrangement, the dimensions of cover 112, base 116 and holder 140, especially lips 142, are precisely sized and shaped and designed to provide the proper amount of give or flex to allow entry and exit of pencil 118 into and out of holder 140.

In one arrangement, the thickness of lips 142 vary along their length to facilitate easy entry and exit of pencil 118 into and out of holder 140. To facilitate easier insertion and removal of pencil 118 within holder 140, in one arrangement a dual-durometer material arrangement is used. That is, in this arrangement, the material of other parts of cover 112 is formed of one material, and the material that forms holder 140 and/or lips 142, or some portion thereof, is formed of a second material that is softer, and/or more flexible or more compressible than the first material. As one example, the majority of cover 112 is formed of a generally rigid plastic material, nylon, PVC or composite or the like material whereas the holder 140 and/or the lips 142 are formed of a semi-flexible or flexible material or more-compressible material such as rubber, synthetic rubber, gel, foam, or the like. In this way, the flexible material deflects more easily to allow entry and exit of pencil 118 into and out of holder 140. In addition, the flexible material of holder 140 and/or lips 142 tends to provide additional grip or increased slip-resistance which is beneficial as it tends to prevent pencil 118 from unintentionally sliding out of holder 140.

In another arrangement, the thickness of lips 142 do not vary along their length. This facilitates a smooth entry and exit of pencil 118 into and out of holder 140 when the pencil 118 is designed to make entry and exit at either the upper end 126 or the lower end 124 of the cover 112. A consistent thickness of lips 142 in this arrangement facilitates easier insertion and removal of pencil 118 by providing a consistent slide of the pencil 118 into the holder 140.

In addition to using a flexible or semi-flexible or somewhat malleable material for holder 140 and/or lips 142 helps to provide additional give and flexibility to accommodate variation between pencils 118 and variation between manufactures of pencils 118. That is, many pencils 118 presently on the market are formed of a relatively standard size, however there may be substantial size variation between pencils 118 and between manufactures of these pencils 118. The configuration of system 110 increases the robustness of the design and helps to reduce the potential of a particular pencil 118 not fitting within holder 140. As such, the configuration of the system 110 allows a user to pair most any pencil 118 with cover 112 and ultimately a base 116. This allows ease of customization as no prior system allows consumers to so easily attach a pencil 118 to a matching lipstick 130 which would be found in a base 116, thereby providing customized pairings.

In addition, using a second material for holder 140 and/or lips 142 allows for use of a material that has a higher coefficient of friction as compared to the material used for the exterior surface of cover 112. In this arrangement, the material used for the exterior surface of cover 112 has a low coefficient of friction thereby allowing the cover 112 to slide easily within a user's pocket, purse or makeup bag; whereas the material used for holder 140 and/or lips 142 is formed of a material that has a higher coefficient of friction thereby helping to hold onto pencil 118 and helping to reduce or prevent unintentional separation thereof. In one arrangement, this material with a higher coefficient of friction may be positioned only on the inward-facing edges of lips 142, and/or only the portions of lips 142 that actually engage pencil 118.

To provide additional give and flexibility to holder 140, one or a plurality of compressible members 148 are placed within the center wall 143 of holder 140 and/or on the end of lips 142. Compressible members 148 are formed of any suitable size, shape and design and serve to provide additional flexibility and give to holder 140. In one arrangement, as is shown, a plurality of compressible members 148 are spaced across the center wall 143 and/or lips 142 and extend inward into the opening in holder 140. In one arrangement, compressible members 148 are formed of a compressible material, flexible material or semi-flexible material such as rubber, synthetic rubber, rubber foam, or the like. Being flexible or compressible allows compressible members 148 to compress when a pencil 118 is placed within holder 140. This allows for holder 140 to be more accommodating or to accept pencils 118 having a broader array of sizes and shapes thereby making the design more robust in nature. In the arrangement shown, compressible members 148, when viewed from above or below appear to be rounded and extend into holder 140 a limited distance. These compressible members 148 can take on any shape, such as fingers, flanges, feet or the like. The compressible members 148 can extend the entire length of holder 140 from lower end 124 to upper end 126, or alternatively they may be shorter and be formed of a plurality of buttons that protrude out into holder 140 intermittently along the length of holder 140. In yet another alternative arrangement, the entire surface of holder 140, and/or center wall 143 may be formed of or coated with a compressible material or flexible material which will provide holder 140 additional give and flexibility.

System 110 also includes a pencil 118. Pencil 118 is formed of any suitable size, shape and design. In the arrangement shown, as one example, where holder 140 includes a generally elongated opening in cover 112, pencil 118 is a generally cylindrical member that extends from a lower end 168 to an upper end 170. A removable cap 122 may cover an end 170 of pencil 118. In the arrangement shown, main body 120 of pencil 118 has a generally cylindrical exterior surface, however any other shape is hereby contemplated for use such as oval, square, rectangular, hexagonal, heptagonal, octagonal, pentagonal, or the like. When cap 122 is removed, the upper end 168 of pencil 118 terminates in a tip that is used in the makeup application process. The when cap 122 is in place on the main body 120 of pencil 118 a step 156 is formed at the at the point where the lower end of cap 122 covers main body 120.

In Operation:

A user selects their desired color of lipstick 130 within base 116 which is held within cover 112. Next the user selects the appropriate color of lip liner or eye liner or appropriate brush, which is in the form of a pencil 118. The user applies the lipstick 130 by grasping base 116, removing base 116 from cover 112 pulling base 116 away from cover 112, such that the base 116 is removed from the hollow interior 134 of cover 112. Next, the user rotates base 116 with respect to lipstick tube 128 to deploy lipstick 130. Next, the user applies lipstick 130 and when done retracts lipstick 130 within lipstick tube 128 by again rotating base 116 with respect to lipstick tube 128. Next, the user places base 116 back into the opening 117 of cover 112 until the base 116 is fully held within and inserted into the hollow interior thereby protecting lipstick 130.

Similarly, the user applies and eyeliner or lip liner using pencil 118. In the arrangement, where pencil 118 includes a cap 122, cap 122 is removed, the makeup is applied using the tip of the pencil 118 or end of a brush. When applied, the cap 122 is replaced over the tip of the pencil 118 until it engages step 156 and is held in place thereby protecting the makeup of the tip of the pencil 118.

Now that the lipstick 130 has been paired with the lip liner or eyeliner or brush of pencil 118 to prevent unintentional separation of the lipstick 130 and the pencil 118 the system 110 is used. That is, the user aligns the main body 120 or any portion of pencil 118 with the holder 140. Once the elongated pencil 118 is aligned with the elongated recess that is the holder 140, the user applies pressure to the pencil 118 forcing the pencil 118 into the opening of holder 140. That is, the user forces the pencil 118 into the holder 140 from the side of the cover 112. As the user applies pressure to pencil 118, because the lips 142 are narrower than the maximum diameter of holder 140 and pencil 118, the lips 142 frictionally engage the exterior surface of pencil 118. As pressure is applied, these lips 142 elastically deflect away from one another thereby allowing pencil 118 to enter and snap into holder 140.

Once pencil 118 is inserted within holder 140, the lips 142 again elastically deflect inward toward one another back toward their original position or close to their original position. Again, because these lips 142 extend past the widest portion of pencil 118 these lips 142 hold pencil 118 within holder 140. In this position, the exterior surface of pencil 118 is in generally flat, flush and frictional engagement with the center wall 143.

In the arrangement where compressible members 148 are positioned within holder 140, or at the end of lips 142, compressible members 148 deform to receive pencil 118 and accommodate any size variations between holder 140 and pencil 118. Compressible members 148 also help to prevent pencil 118 from unintentionally sliding out of holder 140 due to their compressible and high-friction nature.

Alternatively, the pencil 118 may be inserted by inserting the pencil 118 into either end of the elongated recess 141 of the holder 140 and forcing the pencil 118 downward or upward with respect to the cover 112. In doing so, a similar process occurs to that described above, that is the lips 142, and/or holder 140 flexes to accommodate the pencil 118 and frictionally holds the pencil 118 therein once in place.

In this way, the cover 112 of system 110 allows for the insertion (and removal) of the pencil 118 within holder 140 from both the side as well as from above and/or below. This provides improved flexibility of use and convenience.

Once pencil 118 is inserted within holder 140 it is held in place and resists unintentional removal from holder 140. The frictional engagement between holder 140 and pencil 118 helps to hold pencil 118 in place within holder 140. If the arrangement where a compressible material, compressible members 148 or a flexible material is placed within holder 140 or forms lips 142, this material further helps to hold pencil 118 within holder 140.

Once combined, the user can store the combined cover 112, base 116, and pencil 118 without fear that these components will be separated. When it is time to apply the paired makeups again or reapply the paired makeups, time will be saved as the pencil 118 will be held in place within holder 140 and the base 116 will be held in place within the cover 112. This prevents the user from having to search for and re-pair the two previously paired makeups.

To remove the pencil 118 from the holder 140, the user grasps the cover 112 in one hand and the pencil 118 in the other hand. The user then applies force greater than the force of frictional engagement between the pencil 118 and the holder 140. The pencil 118 may be removed by pulling the pencil 118 upward or downward with respect to the cover 112 thereby sliding the pencil 118 out of the holder 140, or by forcing the pencil 118 sideways with respect to cover 112 thereby pulling the pencil 118 out of the holder 140. As force is applied to the pencil 118, the compressible members 148 and/or lips 142 deflect and allow passage of the pencil 118 out of holder 140. In this way, the cover 112 of system 110 allows for removal of the pencil 118 within holder 140 from both the side as well as from above. This provides improved flexibility of use and convenience.

Additional Holders:

While, in the arrangement shown, a single holder 140 is included within cover 112, additional holders 140 are hereby contemplated. That is, two or three or more holders 140 are hereby contemplated for use, such as in the arrangement where in a lipstick 130 is paired with an eyeliner pencil 118 and a lip liner pencil 118 and brush. In the arrangement wherein there are multiple holders 140 they may be placed on opposite sides or in any other portion of cover 112.

Different Shapes:

While, in the arrangement shown, when viewed from above or below cover 112 is formed of a circular shape. However, any other shape is hereby contemplated for use. In one arrangement, with reference to FIG. 28, a cover 112 is viewed from above or below. In this arrangement, cover 112 is generally circular in shape when viewed from above or below and includes an extension off to one side that houses holder 140. This arrangement reduces the overall size of cover 112 and provides a different aesthetic appearance. A similar arrangement is hereby contemplated for two or three or more holders 140.

Holder Configuration:

In one arrangement, holder 140 extends continuously from the upper end 126 of cover 112 to the lower end 124 of cover 112. Alternatively, holder 140 may only extend a portion of the length of cover 112.

In addition, as consumers sharpen pencil 118 the pencil 118 gets shorter. The elongated recess 141 allows the continued and convenient use of the system 110 when the pencil 118 gets short as both the upper and lower ends of holder 140 are open thereby allowing any length of pencil 118 to extend through the holder 140. Additionally, the step 156 which results from having a cap 122 on pencil 118 will prevent the pencil 118 from sliding through holder 140 when the step 156 makes contacted with an end of the holder 140. That is, regardless how short pencil 118 gets, the elongated recess 141 of holder 140 can engage by allowing for a universal length, thereby ensuring that the pencil 118 does not slide down within holder 140, which can make it difficult to remove pencil 118. This allows for consistently easy removal of pencil 118 even when it gets short.

In one arrangement, holder 140 includes a cap recess 158 that is configured to receive and hold cap 122 of pencil 118 therein. In this arrangement, cap recess 158 is a wider portion of holder 140 that is sized and shaped to receive cap 122 therein. In this arrangement, when pencil 118 with cap 122 is positioned within holder 140 and the cap 122 is slid toward the end of holder 140 that includes cap recess 158 therein, the step 156 at the intersection of pencil 118 and cap 122 engages a corresponding step in cap recess 158. In this way, cap 122 is held within cap recess 158 and cap 122 is indexed against the edge of cap recess 158. In one arrangement, when cap 122 is on pencil 118 and cap 122 is positioned within the cap recess 158, this helps to hold cap 122 onto pencil 118 during transport of the system 110. In addition, the engagement of cap 122 into cap recess 158 prevents pencil 118 from sliding through holder 140. In this way, the inclusion of cap recess 158 in association with corresponding cap 122 provides substantial advantages and improves ease and consistency of use.

Figure 22:
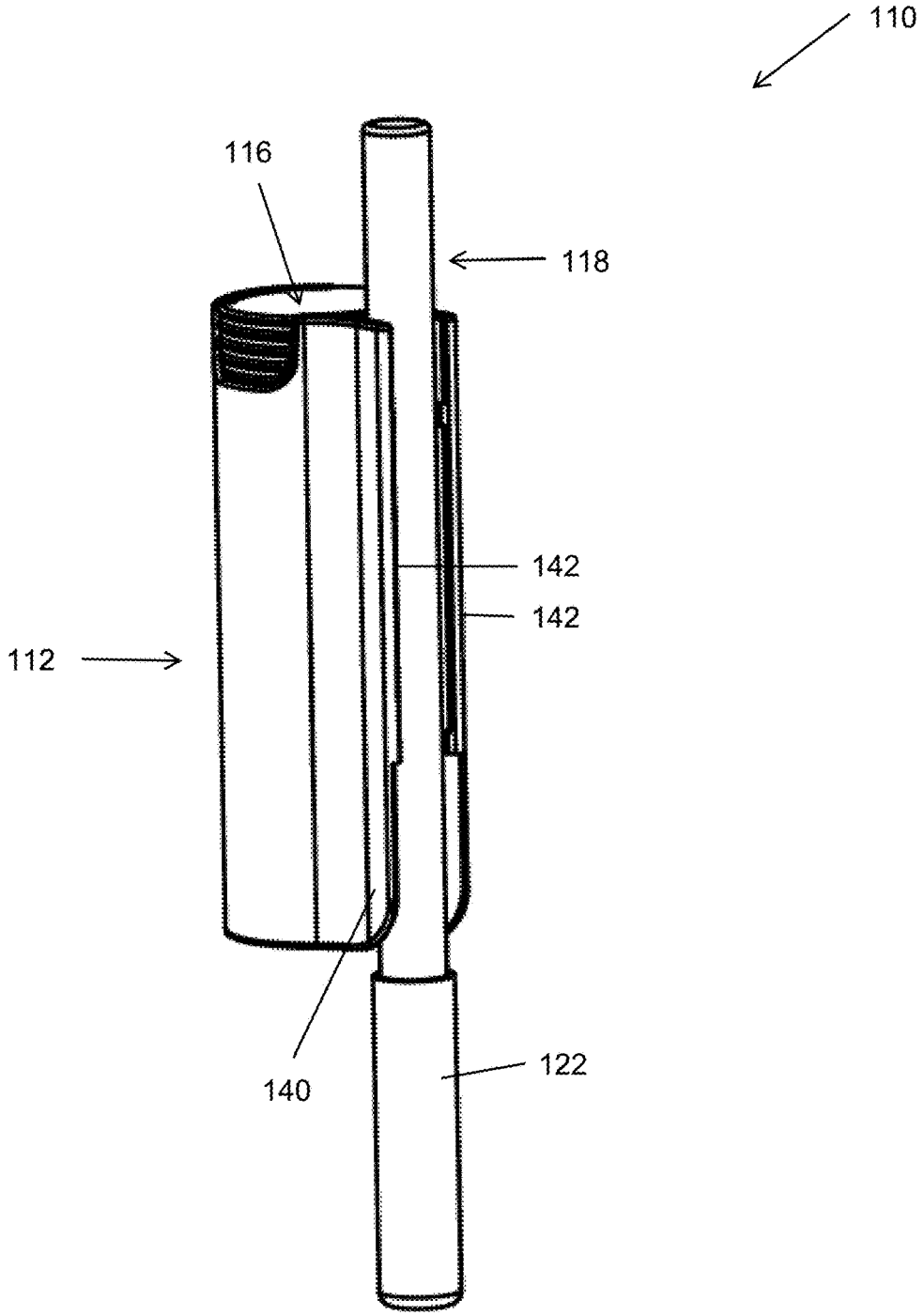
FIG. 22 is a perspective rear view of the arrangement shown in FIG. 19.
Figure 23:
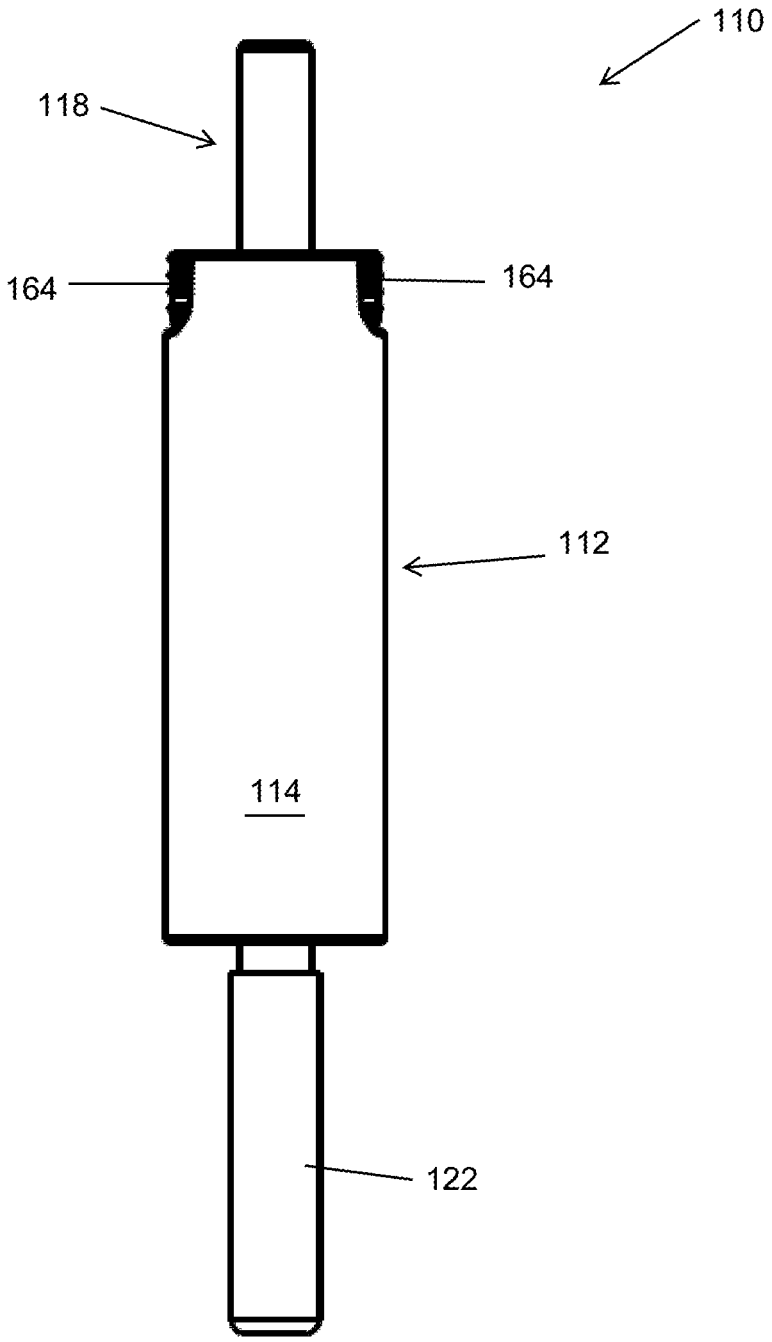
FIG. 23 is a rear elevation view of the arrangement shown in FIG. 19.
Figure 24:
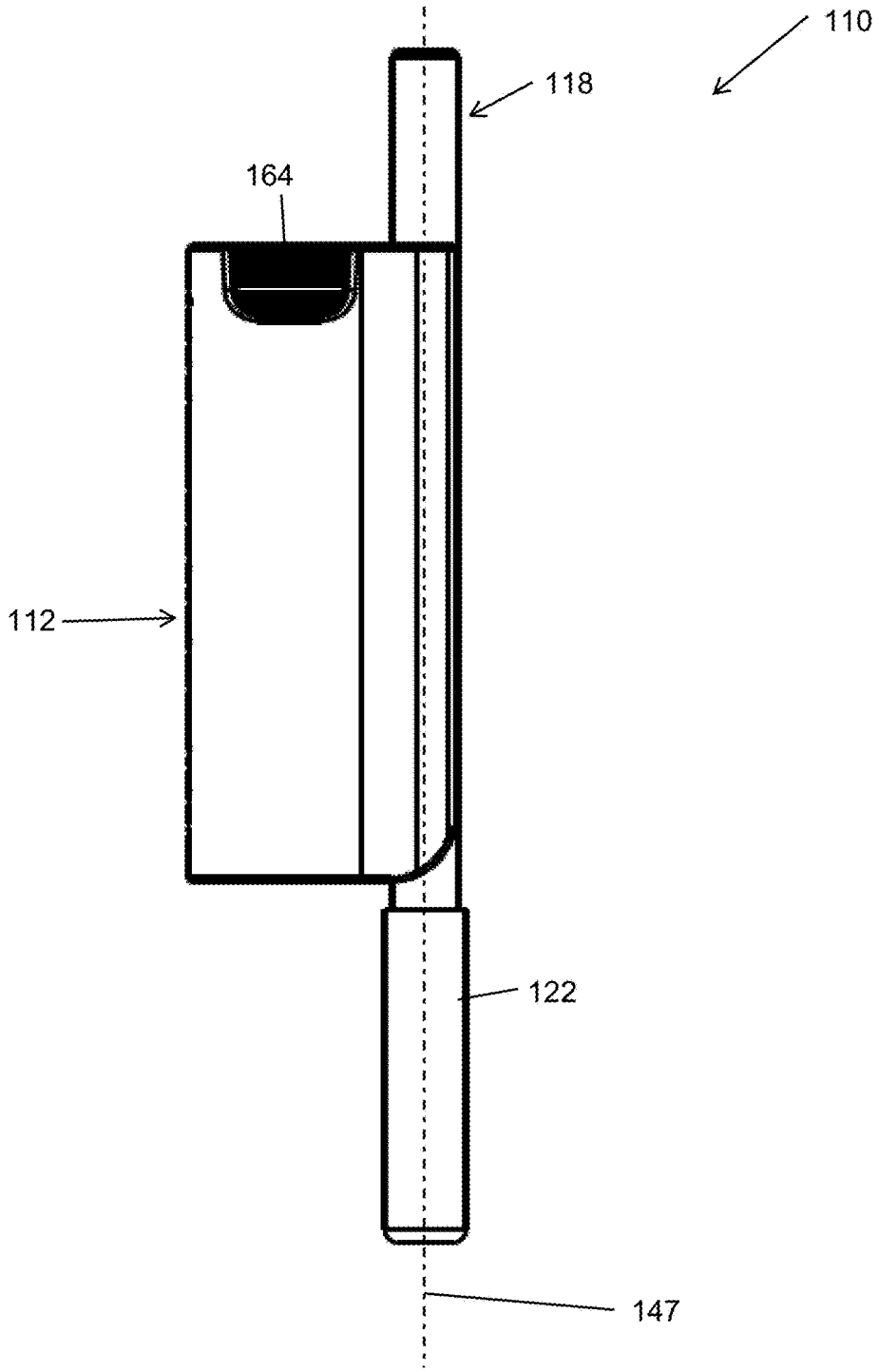
FIG. 24 is a side elevation view of the arrangement shown in FIG. 19.
Figure 25:
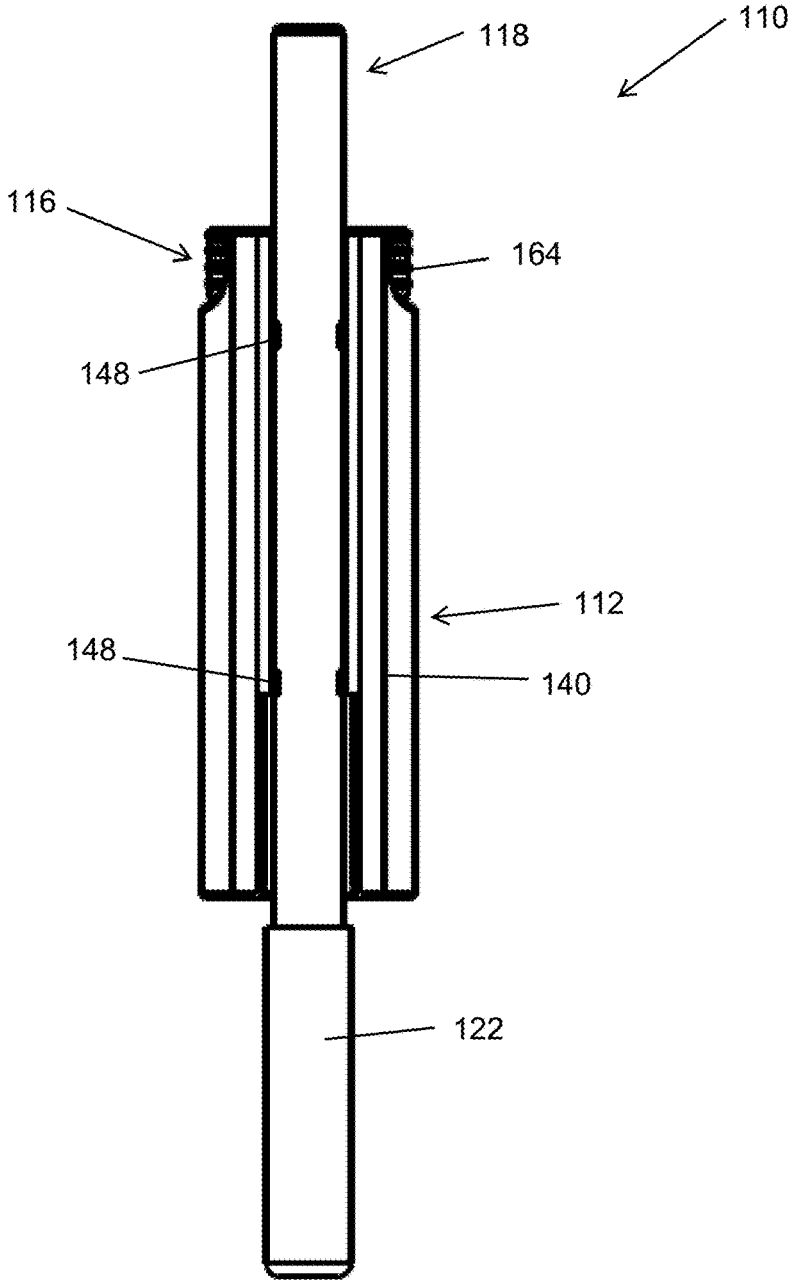
FIG. 25 is a front elevation view of the arrangement shown in FIG. 19.
Figure 26:
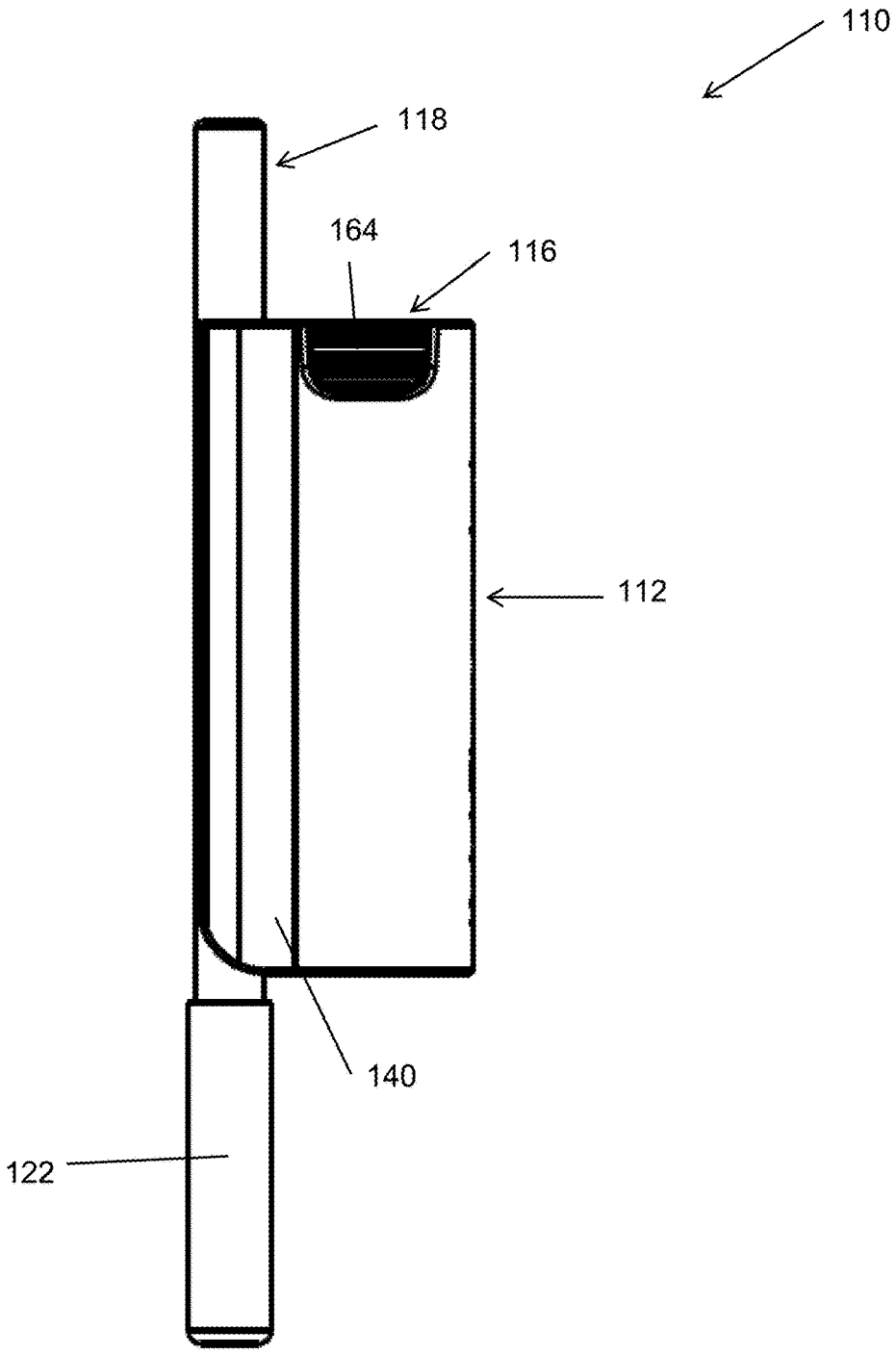
FIG. 26 is a side elevation view of the arrangement shown in FIG. 19.
Figure 27:
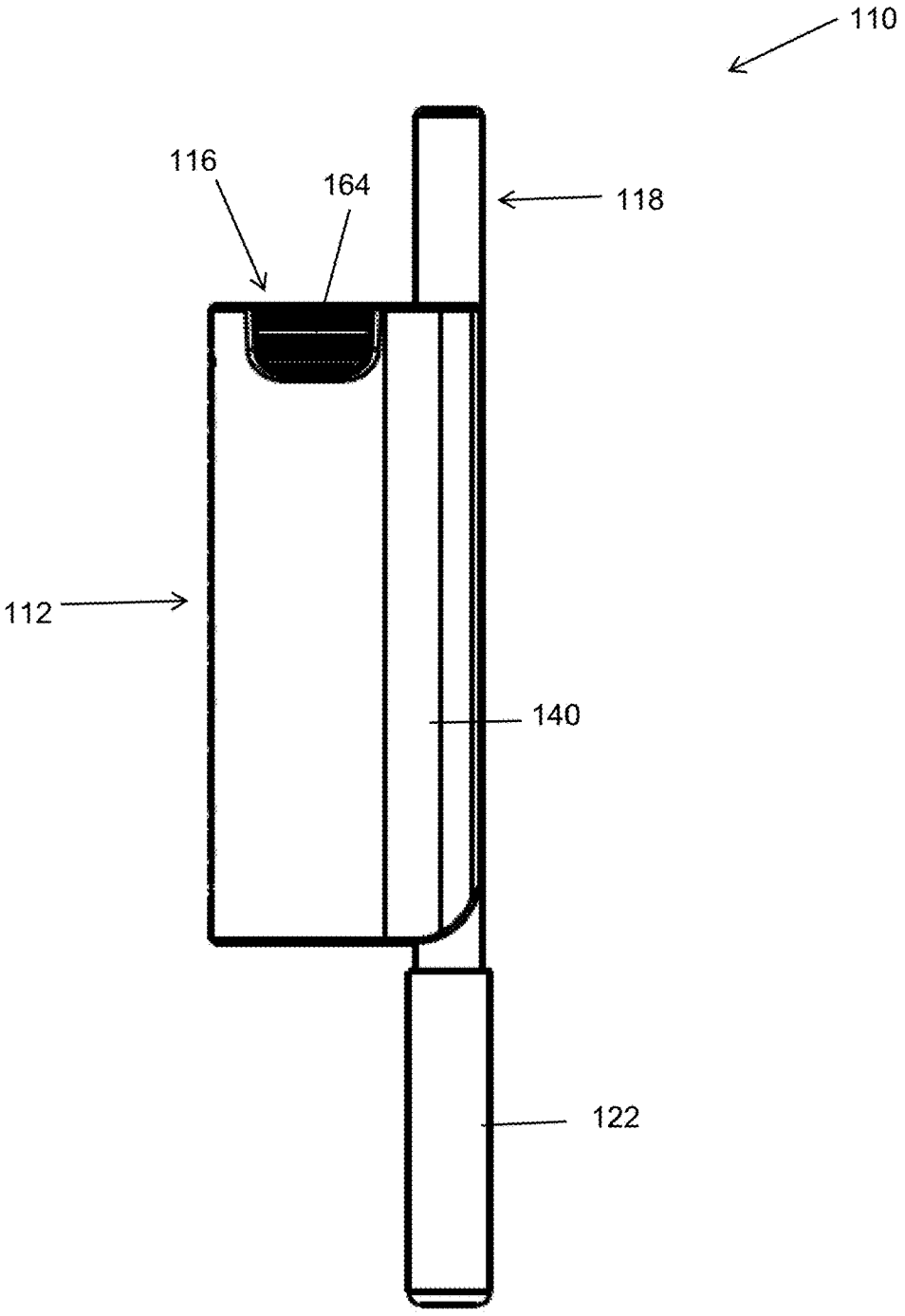
FIG. 27 is a side elevation view of the arrangement shown in FIG. 19.

In the views shown in FIG. 21 and FIG. 22, at least one protrusion 164 is shown in the upper end of base 116. In the arrangement shown, two protrusions 164 are shown, one on each opposing side of the base 116. Protrusion 164 is formed of any suitable size, shape and design and is configured to help hold the base 116 and cover 112 together and prevent unintentional separation while also allowing for easy separation of the two components when desired. In the arrangement shown, protrusion 164 is a grippable protrusion or bulge in the upper end 152 of base 116 that fits within and is received by a first-recess 117 in the upper end 126 of cover 112 when the base 116 is fully inserted within the opening 117 of the cover 112. When inserting or removing base 116 from the cover 112 the user must overcome the frictional engagement of the exterior surface 127 of the base 116 in contact with the interior of the cover 112, and when in a closed position, the engagement of the protrusion 164 of the base 116 within the first-recess 117 of the cover 112, which helps to hold the two components together.

In the arrangement shown, as one example, when viewed from a side, protrusions 164 are generally square or rectangular members that extend outward from the generally cylindrical exterior surface 127 of base 116 a distance and have rounded lower corners. Similarly, when viewed from the side, first-recesses 117 are generally square or rectangular openings in the generally cylindrical exterior sidewall of cover 112 that have rounded lower corners. In this way, when base 116 is inserted within cover 114 protrusions 164 seat within and are indexed within opposing first-recesses 117. That is, the exterior edge of protrusions 164 are in flat and flush engagement and alignment with the edge of first-recesses 117.

This arrangement allows base 116 to be fully inserted within the hollow interior 134 of cover 112 while providing the user access to the exterior surface of protrusions 164 through first-recesses 117 in cover 112. In this way, when base 116 is fully inserted within cover 112, the upper end 152 of base 116 is in approximate flat and flush alignment with the upper end 126 of cover 112. In this way, the first-recesses 117 and corresponding protrusions 164 provide a low-profile arrangement where base 116 may be fully inserted within cover 112.

In this arrangement, to remove the fully inserted base 116 from cover 112, the user simply grasps the exterior surface of opposing protrusions 164 that extend through first recesses 117 in one hand and grasp the exterior surface 114 of cover 112 in the other and sufficient force is applied to pull the two components apart. In one arrangement, to help aid the user in gripping protrusions 164 to aid in removal of base 116 from cover 112, the exterior surface of protrusions 164 include a plurality of ribs, a plurality of features, a plurality of bumps, a plurality of recesses, a textured surface, a material that has a high coefficient of friction, or any other surface treatment that increases grip and eases the user in their need to hold base 116 and remove it from cover 112.

To reassemble base 116 into cover 112, the lower end 150 of base 116 is aligned with the opening 113 in the upper end 126 of cover 112 and the lipstick tube 128 is slid within the hollow interior 134 of cover 112. As the lipstick tube 128 is slid within the hollow interior 134, the protrusions 164 are aligned with the first-recesses 117 in cover. Once aligned, base 116 is fully inserted within hollow interior 134 and the protrusions 164 are received within the first-recesses thereby forming a connected and self-holding combination of cover 112 and base 116.

In one arrangement, a friction fit arrangement, or detent arrangement, is used to hold base 116 into cover 112, such as a slightly recessed or protruding feature, bump or ring in the exterior surface of base 116 that is received within a corresponding slightly recessed or protruding feature, bump or ring in the interior surface 115 of cover 112. To engage these mating features force must be applied, and once these mating components are joined a frictional force holds them together. To remove these mating components, sufficient force must be applied to overcome the frictional engagement. In this way, the base 116 and cover 112 are held together.

Other Makeup Cases:

While a cover 112 is presented herein that is configured to receive a lipstick 130, the invention is not so limited. That is, it is hereby contemplated that the system 110 may be used with any two or more types of makeup, or with a makeup case and any other objects. Examples include, a powder container and a powder brush; a mascara container and an eyeliner pencil, or the like combinations.

Accordingly, from the above discussion it will be appreciated that the improved makeup case and method of use presented offers many advantages over the prior art. Specifically, the improved makeup case and method of use improves upon the present state of the art; is elegant; helps to keep two paired makeups together; is easy to use; is relatively inexpensive to manufacture; helps save a user time; helps prevent user frustration; helps prevent errant re-pairing of makeup; helps to prevent reapplying makeup because the wrong makeup was applied; helps to prevent losing makeup; is safe to use; has a simple design; can be used with any form of makeup; helps to identify what lipstick goes with what lip liner; allows two or more makeups to be quickly joined; allows two or more makeups to be quickly separated; has a robust design; has a long useful life; is durable; has an intuitive design; among countless other improvements and advantages.

It will be appreciated by those skilled in the art that other various modifications could be made to the device without parting from the spirit and scope of this invention. All such modifications and changes fall within the scope of the claims and are intended to be covered thereby.

What is claimed:

1. A lipstick case system, comprising:

a cover:

the cover having an exterior surface;

the cover extending a length from a first end to a second end;

the cover having an opening in the second end;

wherein the opening in the cover is generally cylindrical;

wherein the opening in the cover is configured to receive and hold a base therein;

the cover having a closed first end;

the cover having at least one first-recess in the second end of the cover;

the cover having a holder;

the holder positioned in the exterior of the cover;

the holder formed of an elongated recess in the cover that terminates in a pair of opposing lips that are spaced a distance from one another;

wherein the holder is configured to receive and hold a pencil therein;

a base;

the base having an exterior surface;

the base extending from a first end to a second end;

the base having a generally cylindrical body;

the base having at least one protrusion in the second end of the base;

wherein the at least one protrusion in the base protrudes outward from the generally cylindrical body of the base;

a pencil;

the pencil having an exterior surface;

the pencil extending from a first end to a second end;

the pencil having an elongated main body;

wherein when the base is inserted into the cover the at least one first-recess of the cover is configured to receive the at least one protrusion of the base;

wherein when the base is inserted into the opening of the cover the base is frictionally held within the cover;

wherein when the pencil is inserted into the holder of the cover the pencil is frictionally held within the holder in the space between the opposing lips;

wherein the cover and the base are separate components.

2. The system of claim 1 wherein the elongated recess is formed of a semi-circular shape when viewed from above or below.

3. The system of claim 1 wherein the spacing between the opposing lips is slightly less than a width of the pencil.

4. The system of claim 1 wherein the pencil is inserted into the holder by applying sufficient force to deflect opposing lips.

5. The system of claim 1 wherein the pair of lips extend past a maximum diameter of the holder.

6. The system of claim 1 wherein the pencil is removed from the holder by sliding by applying a force stronger than the frictional force of the holder thereby allowing the pencil to be slid out of and removed from the holder.

7. The system of claim 1 wherein the pencil is removed from the holder, by applying sufficient force to deflect the lips thereby allowing the pencil to be removed from the holder.

8. The system of claim 1 wherein the interior diameter of the holder is sized and shaped to receive and hold the exterior diameter of the pencil.

9. The system of claim 1 wherein the cover is formed of a single monolithic piece.

10. The system of claim 1 wherein the lips are formed of a more-flexible material than the material that forms the other portions of the cover.

11. The system of claim 1 further comprising compressible members positioned within the holder which are configured to help hold the pencil within the holder.

12. The system of claim 1 wherein the holder extends the entire length of the cover from the first end to the second end.

13. The system of claim 1 wherein the interior diameter of the cover is sized and shaped to receive and hold the exterior diameter of the base.

14. The system of claim 1 wherein a cap is connected to the end of the pencil.

15. A lipstick case system, comprising:

a cover;

the cover having an exterior surface;

the cover having an interior surface;

the cover extending a length from a first end to a second end;

the cover having an opening in the second end;

wherein the opening in the cover is configured to receive and hold a base therein;

the cover having a closed first end;

the cover having a holder;

the holder positioned in the exterior of the cover;

the holder having an interior surface;

the holder formed of an elongated recess in the cover that terminates in a pair of opposing lips that are spaced a distance from one another;

wherein the holder is configured to receive and hold a pencil therein;

the cover having a first-recess adjacent the opening in the second end of the cover;

a base;

the base having an exterior surface;

the base extending from a first end to a second end;

the base having a first protrusion that extends outward from an second end of the base;

a pencil;

the pencil having an exterior surface;

the pencil extending from a first end to a second end;

the pencil having a main body;

wherein when the base is inserted into the opening of the cover the base is held within the cover;

wherein when the base is inserted within the cover, the first protrusion of the base is received within the first-recess of the cover;

wherein when the pencil is inserted into the holder of the cover the pencil is held within the holder in the space between the opposing lips;

wherein the cover and the base are separate components.

16. The system of claim 15 wherein the lips extend past a maximum diameter of the holder.

17. The system of claim 15 wherein the cover includes a second-recess and the base includes a second protrusion, wherein when the base is inserted within the cover, the second protrusion of the base is received within the second-recess of the cover.

18. A method of organizing makeup, comprising the steps of:

providing a base, the base having an exterior surface and a at least one protrusion;

providing a cover, wherein the cover is a separate component from the base, the cover having an exterior surface and an interior surface, the cover having an elongated recess formed by opposing lips that are spaced a distance from one another, the cover having a first-recess;

providing a pencil;

inserting the pencil into the elongated recess of the cover;

holding the pencil within the elongated recess of the cover by engagement of the opposing lips and the pencil;

inserting the base into an end of the cover such that the at least one protrusion of the base is received within the first-recess of the cover;

holding the base within the cover by engagement of the exterior surface of the base with the interior surface of the cover;

storing the combined pencil, cover, and base thereby avoiding unintentional separation of the pencil and the base from the cover.

19. The method of claim 18, further comprising the step of removing the pencil from the cover by applying sufficient force to overcome the frictional engagement of the elongated recess with the pencil thereby sliding the pencil away from the cover.

20. The method of claim 18, further comprising the step of removing the base from the cover by applying sufficient force to overcome the frictional engagement of the exterior surface of the base with the interior surface of the cover thereby sliding the base away from the cover.

* * * * *